US008233354B2

(12) United States Patent
Fujisawa

(10) Patent No.: US 8,233,354 B2
(45) Date of Patent: Jul. 31, 2012

(54) RADIO-CONTROLLED TIMEPIECE AND CONTROL METHOD FOR A RADIO-CONTROLLED TIMEPIECE

(75) Inventor: Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 771 days.

(21) Appl. No.: 12/427,425

(22) Filed: Apr. 21, 2009

(65) Prior Publication Data

US 2009/0274011 A1 Nov. 5, 2009

(30) Foreign Application Priority Data

May 2, 2008 (JP) ..... 2008-120566
Jan. 20, 2009 (JP) ..... 2009-010174

(51) Int. Cl.
*G04C 11/02* (2006.01)

(52) U.S. Cl. ..... 368/47

(58) Field of Classification Search ..... 368/47
See application file for complete search history.

(56) References Cited

U.S. PATENT DOCUMENTS 3,881,310 A * 5/1975 Gerum et al. ..... 368/47
7,474,594 B2 1/2009 Urano et al.
7,492,671 B2 * 2/2009 Ogasawara ..... 368/47
7,515,887 B2 4/2009 Saitoh
8,072,845 B2 * 12/2011 Someya ..... 368/47
2006/0176777 A1 * 8/2006 Ihara ..... 368/47
2008/0198697 A1 * 8/2008 Tsuji et al. ..... 368/34

FOREIGN PATENT DOCUMENTS

CN 1828456 A 9/2006
CN 101118414 A 2/2008
JP 10-082874 3/1998

* cited by examiner

*Primary Examiner* — Sean Kayes
(74) *Attorney, Agent, or Firm* — Mark P. Watson

(57) ABSTRACT

A radio-controlled timepiece that receives a standard time signal containing a time code and adjusts internal time data, the radio-controlled timepiece including a reception unit that receives the standard time signal, and a control unit that controls the reception unit. The reception unit has an amplifier circuit that amplifies a reception signal of the standard time signal, and an analog/digital conversion circuit that digitizes the amplified reception signal and acquires a time code. The control unit sets the reception mode of the reception unit to a normal reception mode or to a high sensitivity reception mode that improves reception performance compared with the normal reception mode, sets the reception mode to the high sensitivity reception mode for a specific period that is set based on the time code of the standard time signal after establishing at least second synchronization with the time code of the standard time signal, and otherwise sets the reception mode to the normal reception mode.

8 Claims, 20 Drawing Sheets

BINARY 1 SIGNAL

BINARY 0 SIGNAL

RADIO-CONTROLLED TIMEPIECE AND CONTROL METHOD FOR A RADIO-CONTROLLED TIMEPIECE

CROSS-REFERENCE TO RELATED APPLICATIONS

Japanese Patent application No. 2008-120566, filed May 2, 2008, and Japanese Patent application No. 2009-010174, filed Jan. 20, 2009, are hereby incorporated by reference in their entirety.

BACKGROUND

1. Field of Invention

The present invention relates to a radio-controlled timepiece that receives a standard time signal containing time information and adjusts the time based on the received standard time signal, and to a control method for the radio-controlled timepiece.

2. Description of Related Art

Radio-controlled timepieces that can receive a standard time signal are known from the literature. See, for example, Japanese Unexamined Patent Appl. Pub. JP-A-H10-82874.

The JJY (R) signal transmitted as a standard time signal in Japan is a train of 1-Hz rectangular wave pulses in which a 0.5-second pulse width HIGH signal denotes a 1, a 0.8-second pulse width HIGH signal denotes a 0, and a 0.2-second pulse width HIGH signal denotes a position marker (P). JP-A-H10-82874 teaches a method of sampling the JJY signal by deleting the first 0.2-second portion of the high signal level that is common to all signal pulses and deleting the final 0.2-second low level portion that is also common to all signal pulses.

JP-A-H10-82874 enables eliminating the effects of noise that may be contained in these common parts of each signal by sampling and decoding the received signal using only the portion of each signal where the signal level is different.

However, because JP-A-H10-82874 only teaches adjusting the pulse detection period, sufficient reception performance cannot be achieved when the S/N ratio is low, such as when the reception level is low.

One conceivable way to enable receiving the standard time signal even when the S/N ratio is low is to increase the operating power of the reception circuit to improve the S/N ratio.

However, current consumption also rises if the operating current is increased, thus particularly shortening the duration time in devices such as a wristwatch with low battery capacity.

SUMMARY OF INVENTION

A radio-controlled timepiece and a control method for a radio-controlled timepiece according to the present invention enable improving reception performance while minimizing the increase in power consumption, and can be applied even in wristwatches.

A first aspect of the invention is a radio-controlled timepiece that receives a standard time signal containing a time code and adjusts internal time data, the radio-controlled timepiece including a reception unit that receives the standard time signal, and a control unit that controls the reception unit. The reception unit has an amplifier circuit that amplifies a reception signal of the standard time signal, and an analog/digital conversion circuit that digitizes the amplified reception signal and acquires a time code. The control unit sets the reception mode of the reception unit to a normal reception mode or to a high sensitivity reception mode that improves reception performance compared with the normal reception mode, sets the reception mode to the high sensitivity reception mode for a specific period that is set based on the time code of the standard time signal after establishing at least second synchronization with the time code of the standard time signal, and otherwise sets the reception mode to the normal reception mode.

The control unit in this aspect of the invention can select a normal reception mode or a high sensitivity reception mode as the reception mode of the reception unit. After establishing at least second synchronization with the time code of the standard time signal, the control unit sets the high sensitivity reception mode for a specific period that is set based on the time code of the standard time signal and otherwise sets the normal reception mode, and can thus set the high sensitivity reception mode only in periods in which improving the reception performance is necessary. Use of the high sensitivity reception mode that increases current consumption can therefore be minimized, and the increase in current consumption can be minimized while improving reception performance. More particularly, because the high sensitivity reception mode can be enabled only for a specific period at a specific time for second synchronization with the one-minute time code of the standard time signal, the high sensitivity reception mode can be enabled for only the shortest time that the high sensitivity reception mode is required. Increase in power consumption can therefore be minimized, and reception performance can be improved effectively.

The duration time can therefore be increased and convenience can be improved in a wristwatch with small battery capacity.

Note that establishing second synchronization with the time code of the standard time signal is used herein as synchronizing with the pulses occurring every second in the standard time signal.

Preferably, the specific period is a period for receiving a time information unit of the time code in which there was an error when the time information unit was previously received.

A time information unit or time code unit is used herein as any information unit related to the time values contained in the time code, such as the hour, minute, date (including the cumulative day count), year, and weekday.

The control unit of the invention controls the reception process in the high sensitivity reception mode in the specific period for receiving a time information unit in which there was an error when that time information unit was previously received, and can therefore receive the correct time information.

More specifically, because the high sensitivity reception mode is used when re-receiving a time information unit in which there was an actual reception error due, for example, to a poor reception environment, the probability of successfully receiving the data for a time information unit that previously could not be received can be improved. In addition, because the reception process is controlled in the normal reception mode when receiving a time information unit in which a reception error did not occur, use of a high sensitivity reception mode that increases current consumption can be minimized. The invention can therefore minimize an increase in current consumption while improving reception performance.

Note that when receiving a time information unit of the time code that is transmitted without parity, the high sensitivity reception mode can be used even if the time information unit was successfully received the last time but a reception failure occurred in one of the preceding reception cycles.

More specifically, if an error occurred in the received data can be easily determined for a time information unit that is transmitted with parity by using the parity value for error detection. However, determining if there is an error in the data received for a time information unit that does not have parity requires determining, for example, if the received value is an actually nonexistent value (an impossible value, such as a cumulative day count of 370 days the beginning of the year). If the acquired cumulative day count is off by one, for example, detecting the error may not be possible. More accurate data must therefore be received for time information units without parity than for time information units with parity. Therefore, when the time code is received plural times in one reception process and reception of a time information unit without parity fails even once, setting the high sensitivity reception mode when subsequently receiving that time information unit can improve the probability of being able to receive the correct data and reduce the possibility of receiving the wrong data, and reception performance can be improved.

In another aspect of the invention the specific period is a detection period that is preset according to the pulse width of each bit in the standard time signal.

The standard time signal repeatedly transmits a time code of one period (one cycle) in 60 seconds (60 bits). The pulse width of each bit is normally set to one of three data values, 1, 0, and P. For example, in the standard time signal transmitted in Japan the pulse width of a binary 1 is 0.5 second, the pulse width of a binary 0 is 0.8 second, and the pulse width of a marker (minute marker or position marker) is 0.2 second.

Therefore, if described with reference to receiving the standard time signal transmitted in Japan, the data for each bit in the standard time signal is transmitted at a 1-second interval, the detection periods that are preset according to the pulse width of each bit mean the period for detecting the rising edge of the data pulse of each bit, and the period for detecting the falling edge of each data pulse, or more specifically periods that are set referenced to 0.2 second after, 0.5 second after, and 0.8 second after the rising edge of the pulse. These detection periods are the specific periods that are set based on the time code of the standard time signal.

Because the high sensitivity reception mode is set only in periods set according to the timing of the rising edge and falling edge of each pulse in the invention, the control unit can minimize use of the high sensitivity reception mode that increases current consumption, can reliably detect change in each pulse, and can acquire the correct data.

In another aspect of the invention the specific period is a period for receiving a pulse of which the pulse width of each bit in the standard time signal is less than or equal to a preset pulse width.

This preset pulse width may be set referenced to a narrow pulse width, a pulse width that is difficult to receive if not set to the high sensitivity reception mode. For example, high sensitivity reception mode is preferably set in the period for receiving pulses with a pulse width of 0.2 second or less.

When the pulse width of a pulse that is transmitted at a predetermined timing, such as a marker pulse, is set to less than or equal to this preset pulse width, the period for receiving a pulse of less than or equal to the preset pulse width is the period in which this marker is transmitted, for example. In addition, when the pulse width denoting a 1 or a 0 is a narrow 0.2 second or 0.1 second, such as in the German standard time signal, the period for receiving these data bits is the period for receiving pulses of less than or equal to the preset pulse width. These reception periods are therefore specific periods that are set based on the time code of the standard time signal.

Because the control unit of the invention sets the high sensitivity reception mode in periods in which pulses with a narrow pulse width are known to be received, pulses with a narrow pulse width that are difficult to receive in the normal reception mode can be reliably acquired, and reception performance can be improved accordingly.

Furthermore, because the high sensitivity reception mode is set only in periods in which pulses with a narrow pulse width are known to be received, an increase in current consumption can be suppressed.

In a radio-controlled timepiece according to another aspect of the invention the control unit sets the operating voltage of the reception unit to a higher level when the reception mode is set to the high sensitivity reception mode than when the normal reception mode is set and improves reception performance.

More specifically, the radio-controlled timepiece has a voltage circuit that can switch the voltage applied to the reception unit between plural levels, and when the high sensitivity reception mode is selected, the output voltage of the voltage circuit is increased compared with when the normal reception mode is selected. For example, the reception unit is driven at 1.5 V in the normal reception mode, and the reception unit is driven at 2.4 V in the high sensitivity reception mode.

Because the operating voltage of the reception unit is increased in the high sensitivity reception mode, the dynamic range can be increased and the S/N ratio of the reception unit can be improved. Furthermore, because it is only necessary to incorporate a voltage circuit that can change the output voltage supplied to an existing reception unit, the invention can be easily implemented without needing to greatly change the reception circuit.

In a radio-controlled timepiece according to another aspect of the invention the control unit sets the operating current of the reception unit to a higher level when the reception mode is set to the high sensitivity reception mode than when the normal reception mode is set and improves reception performance.

This aspect of the invention can reduce thermal noise in transistors and can improve the S/N ratio of the reception unit because the operating current of the reception unit is increased in the high sensitivity reception mode compared with the normal reception mode.

Further preferably, the control unit sets only the operating current of the amplifier circuit of the reception unit to a higher level when the reception mode is set to the high sensitivity reception mode than when the normal reception mode is set and improves reception performance.

Because only current to the amplifier circuit is increased, this aspect of the invention can minimize the current increase in the high sensitivity reception mode, and can effectively improve the S/N ratio of the reception unit.

Another aspect of the invention is a control method for a radio-controlled timepiece that receives a standard time signal containing a time code and adjusts internal time data, including a reception unit that receives the standard time signal, and a control unit that controls the reception unit, the reception unit including an amplifier circuit that amplifies a reception signal of the standard time signal, and an analog/digital conversion circuit that digitizes the amplified reception signal and acquires a time code; and the control method setting a reception mode of the reception unit to a high sensitivity reception mode that improves reception performance compared with a normal reception mode for a specific period that is set based on the time code of the standard time signal after establishing at least second synchronization with the time code of the standard time signal, and otherwise setting the reception mode to the normal reception mode.

This aspect of the invention achieves the same operating effect as the radio-controlled timepiece described above.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Embodiment 1

A radio-controlled timepiece 1 according to a first preferred embodiment of the invention is described next with reference to the accompanying figures.

Configuration of the Radio-Controlled Timepiece 1

Figure 1:
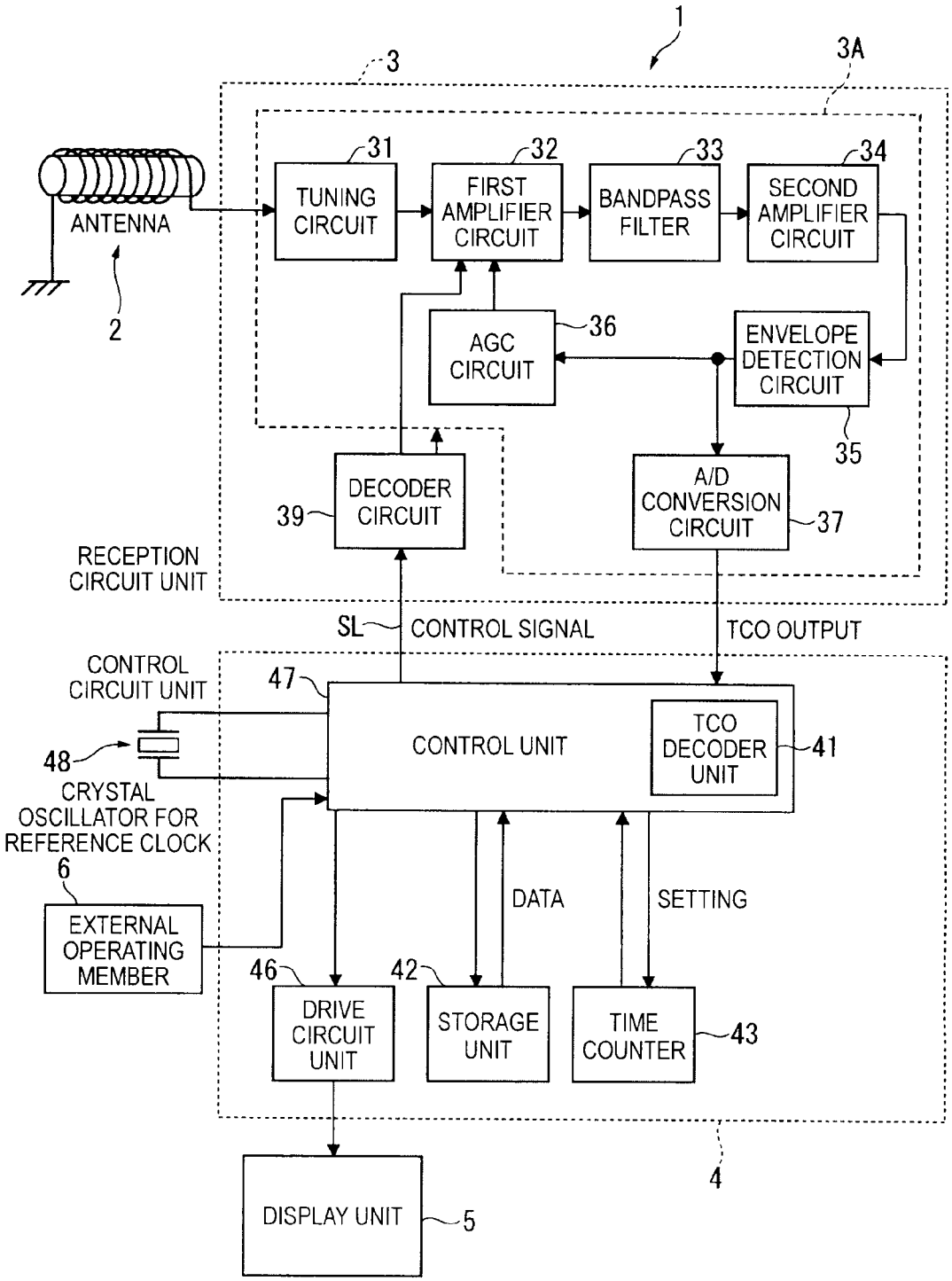
FIG. 1 is a block diagram showing the configuration of a radio-controlled timepiece according to a first embodiment of the invention.

As shown in FIG. 1 the radio-controlled timepiece 1 has an antenna 2 as a reception unit, a reception circuit unit 3, a control circuit unit 4, a display unit 5, an external operating member 6, and a crystal oscillator 48.

The antenna 2 receives a long-wave standard time signal (simply "standard time signal" below) and passes the received standard time signal to the reception circuit unit 3.

The reception circuit unit 3 demodulates the standard time signal received by the antenna 2, and outputs the resulting TCO (time code out) signal to the control circuit unit 4. The reception circuit unit 3 is described in detail further below.

The control circuit unit 4 decodes the input TCO and generates the time data, and sets the time of the time counter 43 based on the generated time data. The control circuit unit 4 also controls displaying the time kept by the time counter 43 on the display unit 5. The control circuit unit 4 also outputs a control signal to the reception circuit unit 3. The control circuit unit 4 is described in detail further below.

Driving the display unit 5 is controlled by the drive circuit unit 46 of the control circuit unit 4 to display the time counted by the time counter 43. The display unit 5 could have a liquid crystal display panel and display the time on the LCD panel, or it could be an analog movement with a dial and hands that are moved as controlled by the control circuit unit 4.

The external operating member 6 is typically a crown or push button that is operated by the user and outputs a prescribed operating signal to the control circuit unit 4. Examples of such operating signals include signal type selection data that sets the type of standard time signal received by the antenna 2 (specifying, for example, whether the received signal is the JJY signal transmitted in Japan, the WWVB signal transmitted in the United States, or the DCF77 signal transmitted in Germany), and a signal requesting a manual reception process causing the standard time signal to be received and the time set.

The crystal oscillator 48 for the reference clock outputs a prescribed clock signal (such as a 1-Hz signal for keeping the time or a 32-kHz clock signal for operating the control unit 47). The clock signal output by the crystal oscillator 48 is input to the control circuit unit 4.

Configuration of the Reception Circuit Unit

As shown in FIG. 1, the reception circuit unit 3 has a tuning circuit 31, a first amplifier circuit 32, a bandpass filter 33, a second amplifier circuit 34, a envelope detection circuit 35, an AGC (automatic gain control) circuit 36, an A/D conversion circuit 37, and a decoder circuit 39. The reception unit 3A of the invention is rendered by the parts of the reception circuit unit 3 not including the decoder circuit 39, that is, by the parts including tuning circuit 31 to the A/D conversion circuit 37.

The tuning circuit 31 has a capacitor, and the tuning circuit 31 and antenna 2 together render a parallel resonance circuit. The tuning circuit 31 causes the antenna 2 to receive signals of a particular frequency. The tuning circuit 31 converts the standard time signal received by the antenna 2 to a voltage signal, and outputs to the first amplifier circuit 32. The reception circuit unit 3 in this aspect of the invention can receive standard time signals transmitted in different formats, including the Japanese JJY signal, the WWVB signal in the United States, the DCF77 signal transmitted in Germany, the MSF signal transmitted in Great Britain, and the BPC signal transmitted in China.

The time information (time code) conforms to a time code format that is predetermined according to the country.

Figure 2:
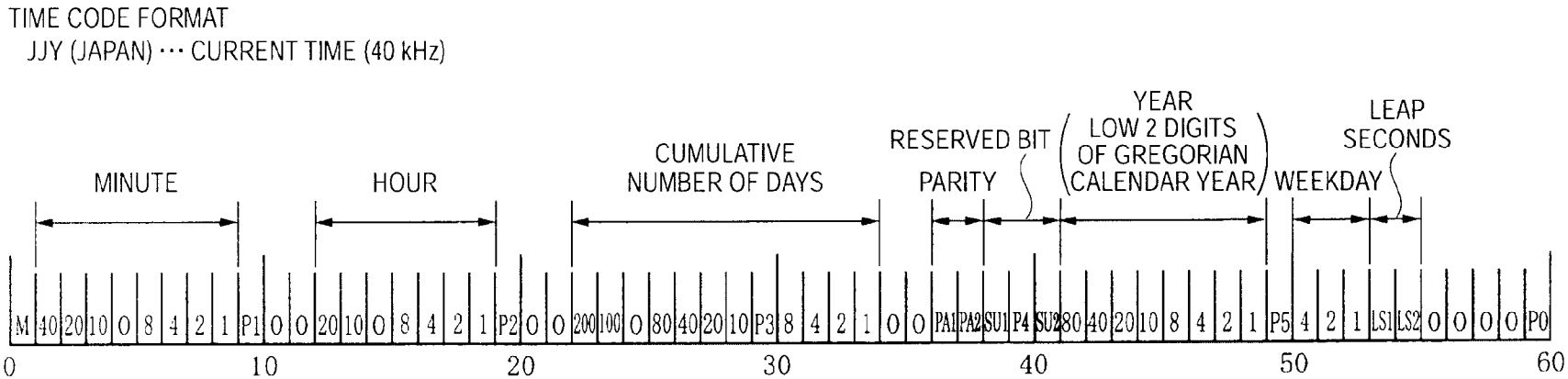
FIG. 2 shows the time code format of the JJY standard time signal in Japan.

As shown in FIG. 2, the time code format of the JJY standard time signal transmitted in Japan carries one bit per second, and transmits one record over 60 seconds. In other words, one frame contains 60 data bits. Data fields include the hour and minute of the current time, calendar information including the number of days since January 1 of the current year and the year (the lowest two digits of the Gregorian calendar year), the day of the week, and the leap seconds. The value of each field is derived from the sum of the values assigned to each bit (each second), and whether a particular bit is on or off is determined from the signal type.

Note that in FIG. 2 "M" represents a frame reference marker denoting the full minute (second 0 of each minute), and P1 to P5 and P0 are position markers, that is, bits representing predetermined positions in the time code. The frame reference marker M and position markers P have a narrow pulse width, and are transmitted timed to seconds 0, 9, 19, 29, 39, 49, and 59. These marker bits are signals with an approximately 0.2 second pulse width, signals denoting an ON level (a binary 1) in each data field have an approximately 0.5 second pulse width, and signals denoting an OFF level (a binary 0) in each data field have an approximately 0.8 second pulse width.

Note, also, that the JJY standard time signal in Japan is transmitted at 40 kHz (in eastern Japan) and at 60 kHz (in western Japan), but the time code format is the same in both signals.

Furthermore, while not shown in the figures, the time code format of the DCF77 signal transmitted in Germany has minute, hour, date, weekday, month, and year fields. Bits 0-14 are unused, and the locations of the position markers P1, P2, P3 and the minute marker M therefore differ from the locations in the JJY signal shown in FIG. 2. Fields preceding the time code units include a service request bit (R) reserved for antenna use, a bit (A1) announcing a daylight savings change, bits (Z1 and Z2) indicating if daylight savings or standard time is in use, a bit (A2) announcing a leap second, and a bit (S) indicating the start of the time information.

Also not shown in the figures, the time code format of the WWVB signal transmitted in the United States has fields for the minute, hour, date, and year. The WWVB signal is transmitted at 60 kHz, the same frequency used for the JJY signal in western Japan, but the location of the year information differs from the JJY format, thus enabling differentiating the JJY and WWVB signals by analyzing the data.

Also not shown in the figures, the time code format of the MSF time signal transmitted in Britain and the BPC time signal transmitted in China also differ from the signals transmitted in other countries, and the source of the time signal can be determined from the format (data) of the received time information (time code).

The first amplifier circuit 32 is rendered to adjust the gain according to a signal input from the AGC circuit 36, and enables selecting a normal reception mode or a high sensitivity reception mode according to signal input from the decoder circuit 39.

Figure 3:
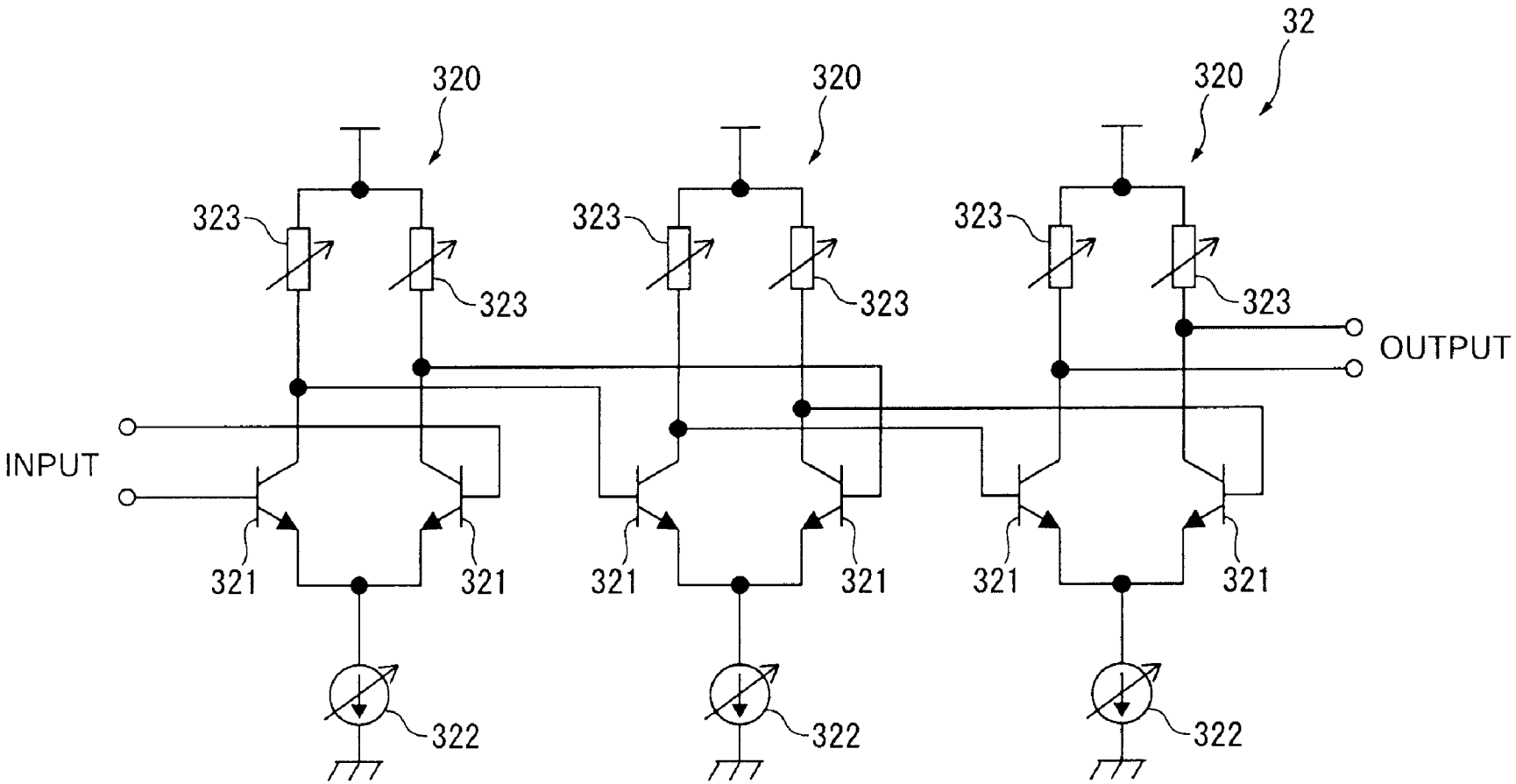
FIG. 3 is a circuit diagram showing the configuration of a first amplifier circuit.

An amplifier circuit known from the literature can be used as the first amplifier circuit 32, but this embodiment of the invention uses a differential amplifier circuit as shown in FIG. 3.

The first amplifier circuit 32 has differential amplifier circuits 320 disposed in three stages. The differential amplifier circuits 320 are common differential amplifiers having two transistors 321, a constant current source 322 connected to the emitter of each transistor 321, and a collector resistance 323 connected to the collector of each transistor 321.

The constant current source 322 is able to switch the current output between a plurality of levels. When the high sensitivity reception mode is selected by signal input from the decoder circuit 39, the first amplifier circuit 32 increases the current output of the constant current source 322 to increase the amount of current flowing through the first amplifier circuit 32 compared with when the normal reception mode is selected.

More specifically, increasing the operating current of the first amplifier circuit 32 can reduce thermal noise in the transistor 321 and improve the S/N ratio of the reception unit 3A, thereby enabling setting a high sensitivity reception mode.

When the operating current increases in the first amplifier circuit 32, the amplification rate (gain) changes and the amplitude of the reception signal changes. As a result, the A/D conversion circuit 37 may produce errors during the A/D conversion process until the response of the AGC circuit 36 stabilizes. Therefore, to prevent the gain from changing when the constant current source 322 changes the operating current, control to reduce the resistance of the load resistance (collector resistance 323), for example, is also necessary.

Because only the first amplifier circuit 32 current is increased in the high sensitivity reception mode in this embodiment of the invention, the current increase when the high sensitivity reception mode is selected can be minimized and the effect of improved reception sensitivity can be improved.

The gain-adjusted first amplifier circuit 32 amplifies the reception signal input from the tuning circuit 31 to a constant amplitude level for input to the bandpass filter 33. More specifically, the first amplifier circuit 32 reduces the gain when the amplitude of the signal input from the AGC circuit 36 is high and increases the gain when the amplitude is low so that the reception signal is amplified to a constant output amplitude.

The bandpass filter 33 is a filter that extracts a signal of a desired frequency band. More specifically, passing the signal through the bandpass filter 33 removes everything but the carrier component from the reception signal input from the first amplifier circuit 32.

The second amplifier circuit 34 then amplifies the reception signal input from the bandpass filter 33 by a fixed gain rate.

The envelope detection circuit 35 has a rectifier not shown and a low-pass filter (LPF) not shown, rectifies and filters the reception signal input from the second amplifier circuit 34, and outputs the filtered envelope signal to the AGC circuit 36 and A/D conversion circuit 37.

The AGC circuit 36 outputs a signal that determines the gain used by the first amplifier circuit 32 when amplifying the reception signal based on the reception signal input from the envelope detection circuit 35.

The A/D conversion circuit 37 is a binary comparator that digitizes the envelope signal input from the envelope detection circuit 35 by comparison with a predetermined threshold value (reference voltage), and outputs the resulting digital signal, that is, the TCO signal.

More specifically, the A/D conversion circuit 37 outputs a signal with a HIGH level voltage when the voltage of the envelope signal is greater than the reference voltage, and outputs a LOW level signal with a voltage that is below the HIGH level voltage when the voltage of the envelope signal is less than the reference voltage, as the TCO signal output to the control unit 47 of the control circuit unit 4. It will also be obvious that a LOW level signal could be output as the TCO signal to the control unit 47 of the control circuit unit 4 when the envelope signal voltage is greater than the reference voltage, and a HIGH level signal could be output as the TCO signal when the envelope signal voltage is less than the reference voltage.

The decoder circuit 39 is connected to the control circuit unit 4 described below by a serial communication line SL.

The decoder circuit 39 decodes the control signal and clock signal input from the control circuit unit 4, controls turning the power to the reception unit 3A on and off, and controls whether the first amplifier circuit 32 operates in the normal reception mode or the high sensitivity reception mode.

Control Circuit Unit Configuration

As described above the control circuit unit 4 controls operation of the reception circuit unit 3, and more specifically outputs control signals to the decoder circuit 39 of the reception circuit unit 3 to control the power on/off state of the reception circuit unit 3 and to control selecting the reception mode of the first amplifier circuit 32. The control circuit unit 4 decodes the TCO signal input from the A/D conversion circuit 37, and sets the time of the time counter 43 based on the decoded time code. The control circuit unit 4 also controls displaying the time of the time counter 43 on the display unit 5.

As shown in FIG. 1 the control circuit unit 4 includes a storage unit 42, the time counter 43, a drive circuit unit 46, and a control unit 47. The control unit 47 includes a TCO decoder unit 41 as a time code decoding unit, and the clock signal output from the crystal oscillator 48 is input to the control unit 47.

The TCO decoder unit 41 of the control unit 47 decodes the TCO signal input from the A/D conversion circuit 37 of the reception circuit unit 3, and extracts the time code containing the date information and time information that is contained in the TCO signal.

Figure 4A:
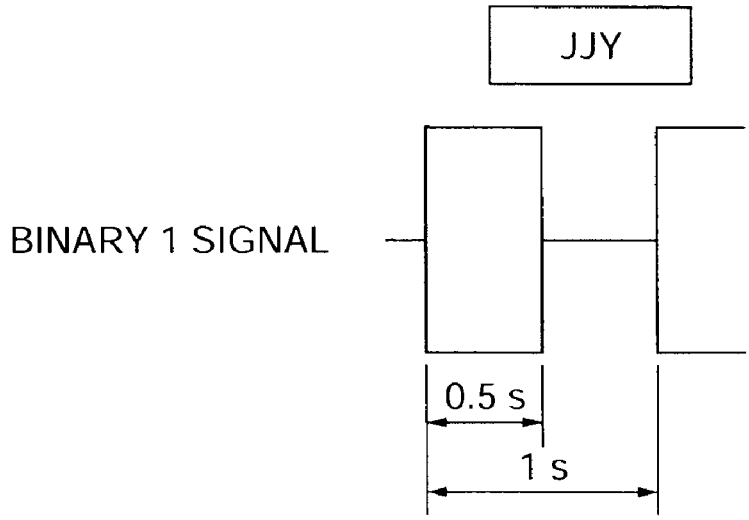
FIGS. 4A, 4B, and 4C show the pulse width of each signal in the JJY standard time signal in Japan.
Figure 4B:
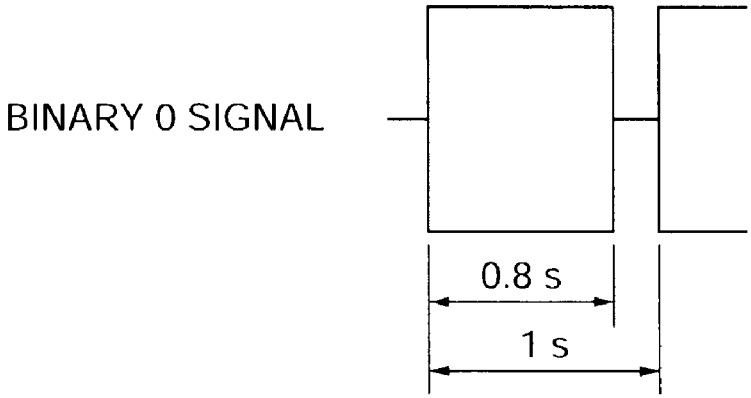
Figure 4C:
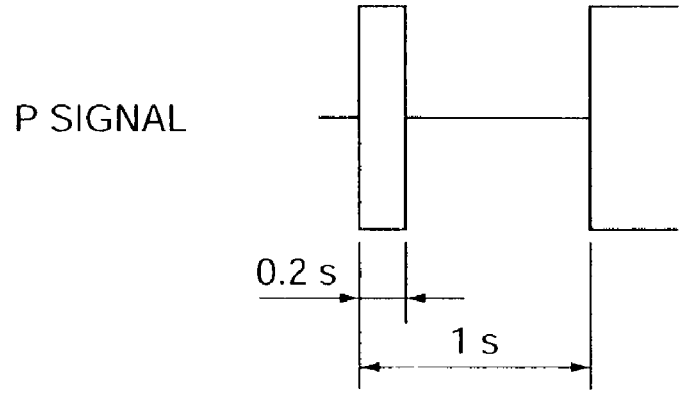

More specifically, the TCO decoder unit 41 recognizes the waveform of the TCO signal, and measures the received pulse duty cycle relative to a prescribed pulse width (such as 1 Hz). The TCO decoder unit 41 then recognizes the time code from the TCO signal based on differences in the duty of the received pulses. For example, the JJY standard time signal transmitted in Japan carries three types of pulses at 1 bps as shown in FIG. 4 with a HIGH pulse width of 0.5 second (50% duty cycle) denoting a binary 1 (a 1 signal), a HIGH pulse width of 0.8 second (80% duty cycle) denoting a binary 0 (0 signal), and a HIGH pulse width of 0.2 second (20% duty cycle) denoting a position marker (P signal). The TCO decoder unit 41 recognizes the particular time code of the JJY signal from the sequence of 1s, 0s, and P signals in the time code.

Figure 5A:
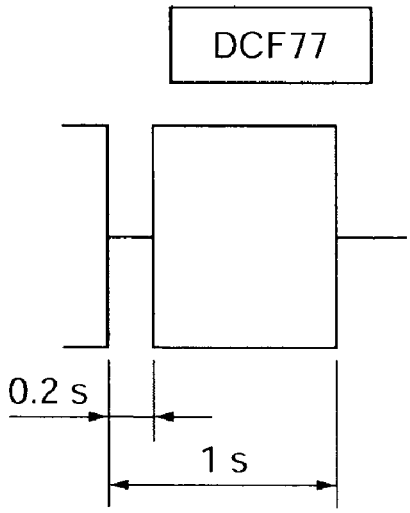
FIGS. 5A and 5B show the pulse width of each signal in the DCF77 standard time signal that is broadcast in Germany.
Figure 5B:
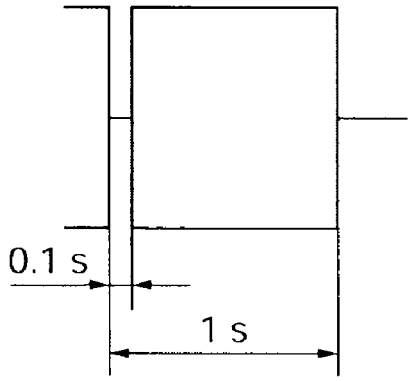

While the time code of the JJY time signal can be recognized as described above, the time code carried by other types of time signals can also be identified from the duty ratio of the encoded pulses. For example, while not shown in the figures, a binary 1 in the WWVB standard time signal broadcast in the United States has a duty cycle of 50%, a binary 0 has a duty cycle of 20%, and the P signal has a duty cycle of 80%. In the DCF77 standard time signal broadcast in Germany, a binary 1 has a duty cycle of 80% and a binary 0 has a duty cycle of 90% as shown in FIG. 5. While also not shown in the figures, in the MSF standard time signal broadcast in Great Britain, a binary 1 has a duty cycle of 80%, a binary 0 has a duty cycle of 90%, and the P signal has a duty cycle of 50%.

The storage unit 42 is memory for storing the data and programs required by the control circuit unit 4 to control the reception circuit unit 3. The storage unit 42 stores a signal data table that is compiled when the radio-controlled timepiece 1 is manufactured and records signal data related to the standard time signals received by the reception circuit unit 3.

This signal data table records signal type data linked to the time code format of the signal type as one signal data record, and stores a plurality of signal data records in a table.

The signal type data is information related to the type of standard time signal received by the reception circuit unit 3, such as JJY, WWVB, DCF77, and MSF.

The time code format is the format of the time code contained in the standard time signal identified by the signal type data, that is, the sequence and duration of the data denoting the year, month, date, hour, and minute.

Figure 6:
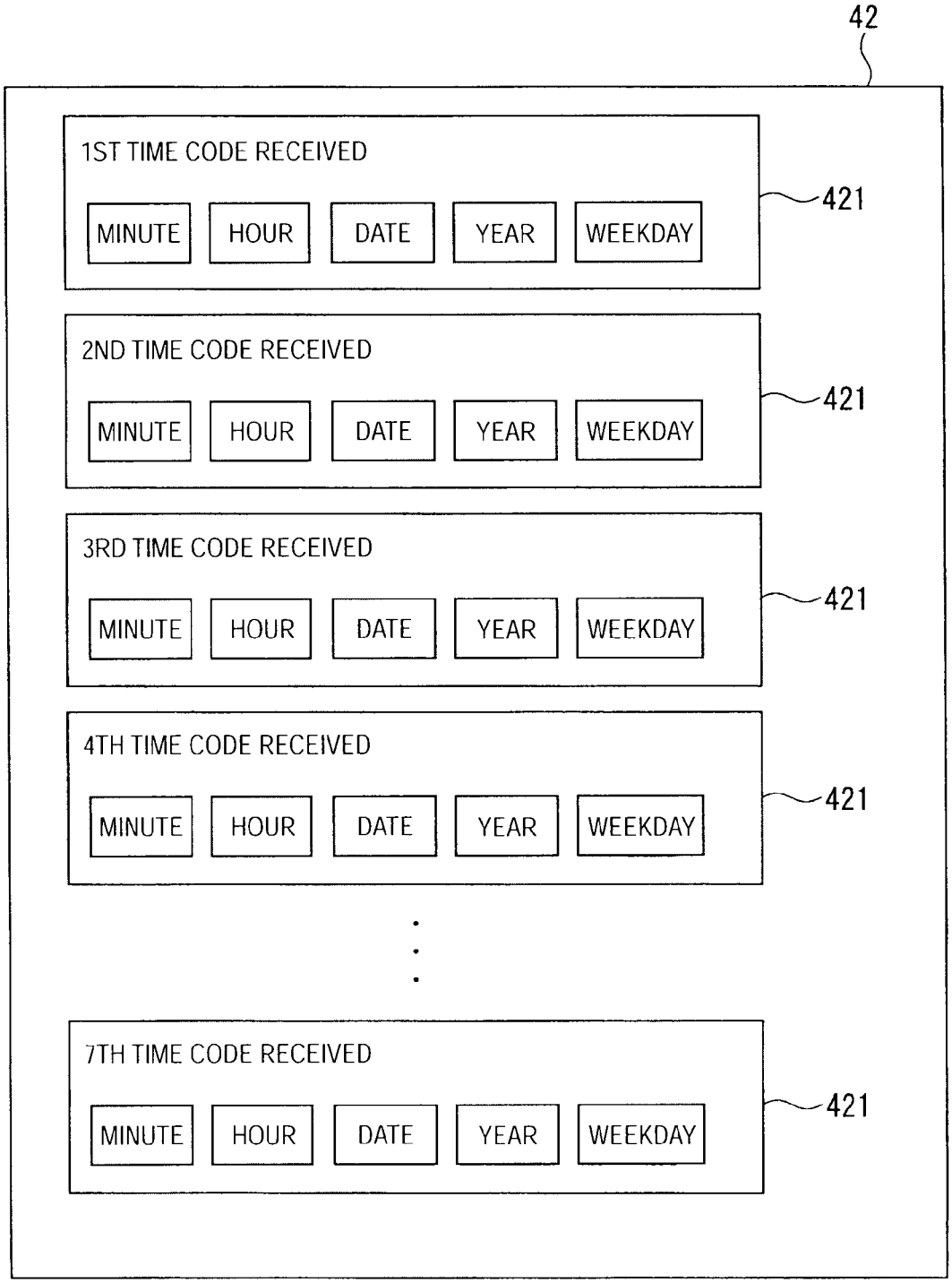
FIG. 6 is a block diagram showing the configuration of the storage unit.

The received time data 421 is also stored in the storage unit 42 as shown in FIG. 6. In this embodiment of the invention the storage unit 42 can store the time data 421 from a maximum seven reception operations. Each time data 421 record stored in the storage unit 42 contains data for the minute, hour, day, year, and weekday time units.

Because the standard time signal transmits one time code record per minute, continuing reception until seven consecutive records have been received acquires time data 421 for seven minutes. Each time data 421 record differs by one minute. Therefore, if the time derived by adding one minute to one time data 421 record matches the time indicated by the time data 421 that is received next, it can be expected that the correct time was received.

The time counter 43 keeps the time based on the reference signal output from the crystal oscillator 48, and includes a time counter for the internal time data and a time counter for the time that is displayed on the timepiece.

More specifically, each counter includes a second counter that counts the seconds, a minute counter that counts the minutes, and an hour counter that counts the hours.

When the crystal oscillator 48 outputs a 1-Hz reference signal, the second counter is a loop counter that repeats every time it counts 60 reference signals, or every 60 seconds. The minute counter is a loop counter that counts one each time 60 1-Hz reference pulses are counted, and repeats every 60 minutes, that is, after counting to 60. The hour counter is a loop counter that counts one every 3600 pulses of the 1-Hz reference signal, and repeats every 24 count, that is, every 24 hours.

The second counter can be configured to output a signal to the minute counter every time the second counter counts to 60, and the minute counter can be configured to increment when this signal is applied from the second counter. Likewise, the minute counter can be configured to output a signal to the hour counter every time the minute counter counts to 60, and the hour counter can be configured to increment when this signal is applied from the minute counter.

The time counter for internal timekeeping is updated to the received time data when time code reception is successful, and is otherwise incremented according to the reference signal.

The time counter for the displayed time normally keeps the same time (count) as the time counter for internal timekeeping, but when the user sets a different time zone, the time difference to the time zone set by the user is added to the time counter for the displayed time. For example, when the time displayed by the radio-controlled timepiece 1 is set by receiving the standard time signal in Japan, the user then leaves Japan, travels overseas, and changes the time zone to display the current local time at the destination, the counts kept by the counters will differ by the time difference between the time zones.

As shown in FIG. 2, the time code format of the JJY signal transmits one bit per second and transmits one record in 60 seconds. One frame therefore contains 60 data bits. The data fields include the minute and hour of the current time, and calendar information including the number of days since January 1 of the current year, the year (the last two digits of the Gregorian calendar year), and the weekday. The value of each field is derived from the sum of the values assigned to each bit (each second), and whether a particular bit is on or off is determined from the signal type.

Based on the time display control signal output from the control unit 47, the drive circuit unit 46 controls the display state of the display unit 5 and controls displaying the time on the display unit 5. For example, if the display unit 5 has an LCD panel and displays the time on the LCD panel, the drive circuit unit 46 controls the LCD panel based on the time display control signal and controls displaying the time on the LCD panel. If the display unit 5 has a movement with a dial and hands, the drive circuit unit 46 outputs a pulse signal to the stepping motor that drives the hands and thus controls moving the hands using the drive force from the stepping motor.

The control unit 47 is driven based on the clock signal input from the crystal oscillator 48 to execute different control processes. More specifically, the control unit 47 outputs the time data decoded by and acquired from the TCO decoder unit 41 to the time counter 43, and controls adjusting the count of the time counter 43. The control unit 47 also outputs a time display control signal for displaying the time kept by the time counter 43 on the display unit 5 to the drive circuit unit 46.

The control unit 47 also outputs a control signal controlling the power on/off state of the reception unit 3A, and a control signal controlling the reception mode of the first amplifier circuit 32, to the decoder circuit 39.

More specifically, when a preset reception time comes or manual reception is triggered by the external operating member 6, the control unit 47 sends a control signal to turn the reception unit 3A power on, causing the reception unit 3A to operate and start the reception process. As further described below the control unit 47 sets the reception mode of the first amplifier circuit 32 to the high sensitivity reception mode for a predetermined period that is set based on the received time code.

As described above, the control unit 47 and the decoder circuit 39 are connected by a serial communication bus SL, and the control signal is input through the serial communication bus SL to the decoder circuit 39.

A two-line synchronous interface enabling two-way communication between the control unit 47 and reception circuit unit 3 can be used to enable two-way serial communication by both the control unit 47 and the reception circuit unit 3. In this configuration the control unit 47 outputs a control signal to the reception circuit unit 3, the reception circuit unit 3 then returns the received and recognized control signal to the control unit 47, and the control unit 47 detects any difference in the data of the control signal output by the control unit 47 and the control signal input to the control unit 47, thereby assuring highly reliable serial communication.

Reception Operation of the Radio-Controlled Timepiece

The standard time signal reception operation of the radio-controlled timepiece 1 according to this embodiment of the invention is described next.

Figure 7:
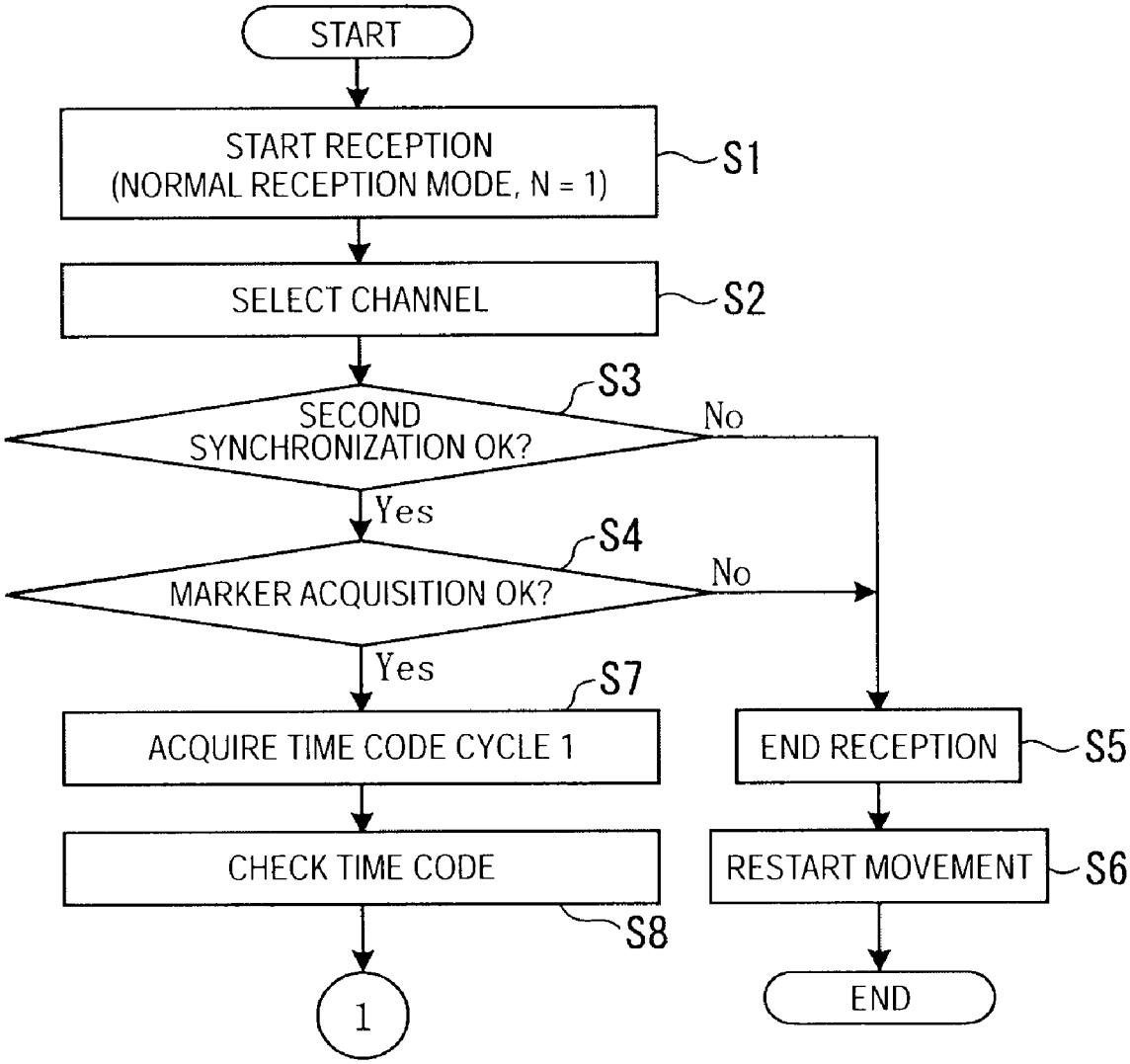
FIG. 7 is a flow chart showing the signal reception operation in the first embodiment of the invention.
Figure 8:
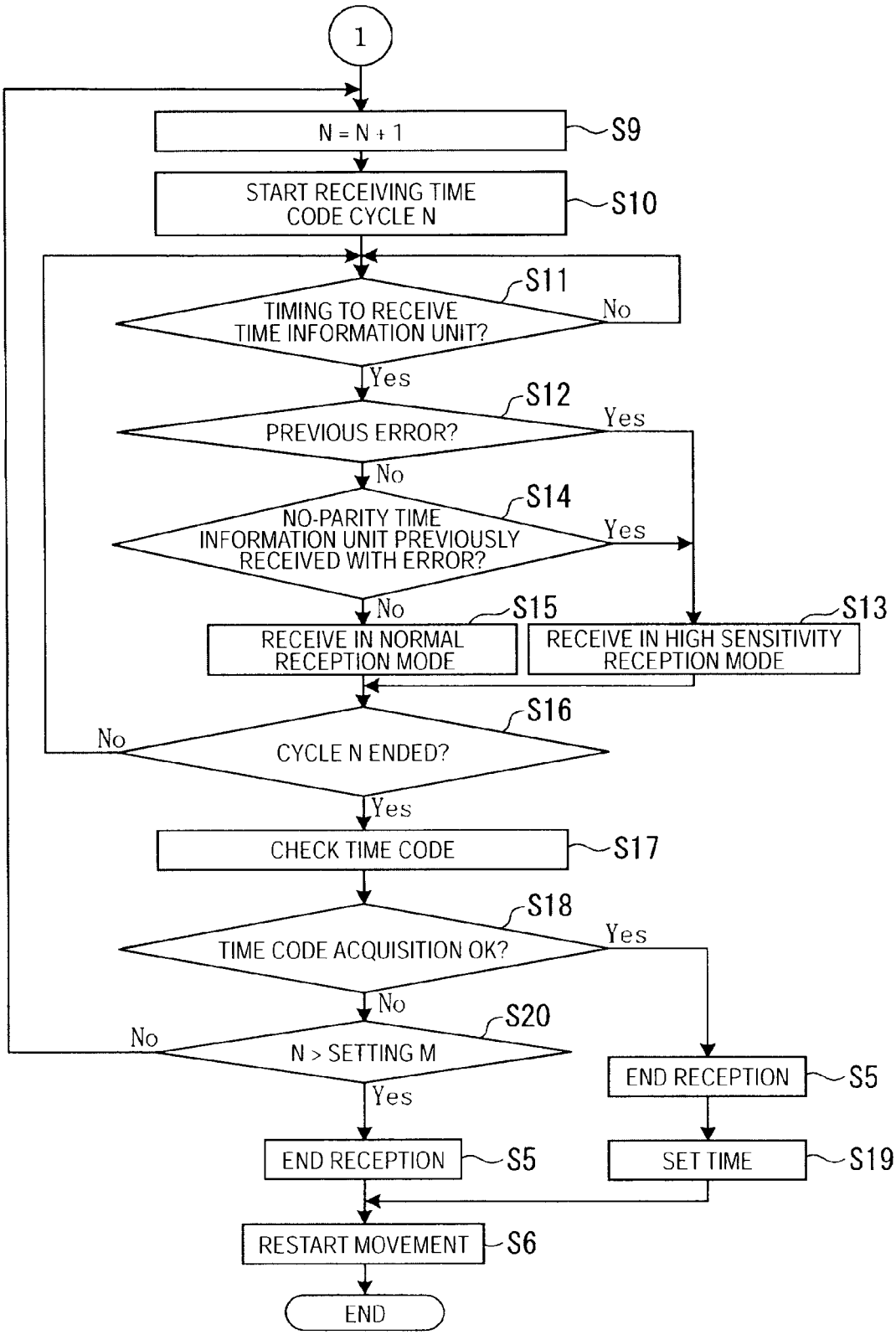
FIG. 8 is a flow chart showing the signal reception operation in the first embodiment of the invention.
Figure 9:
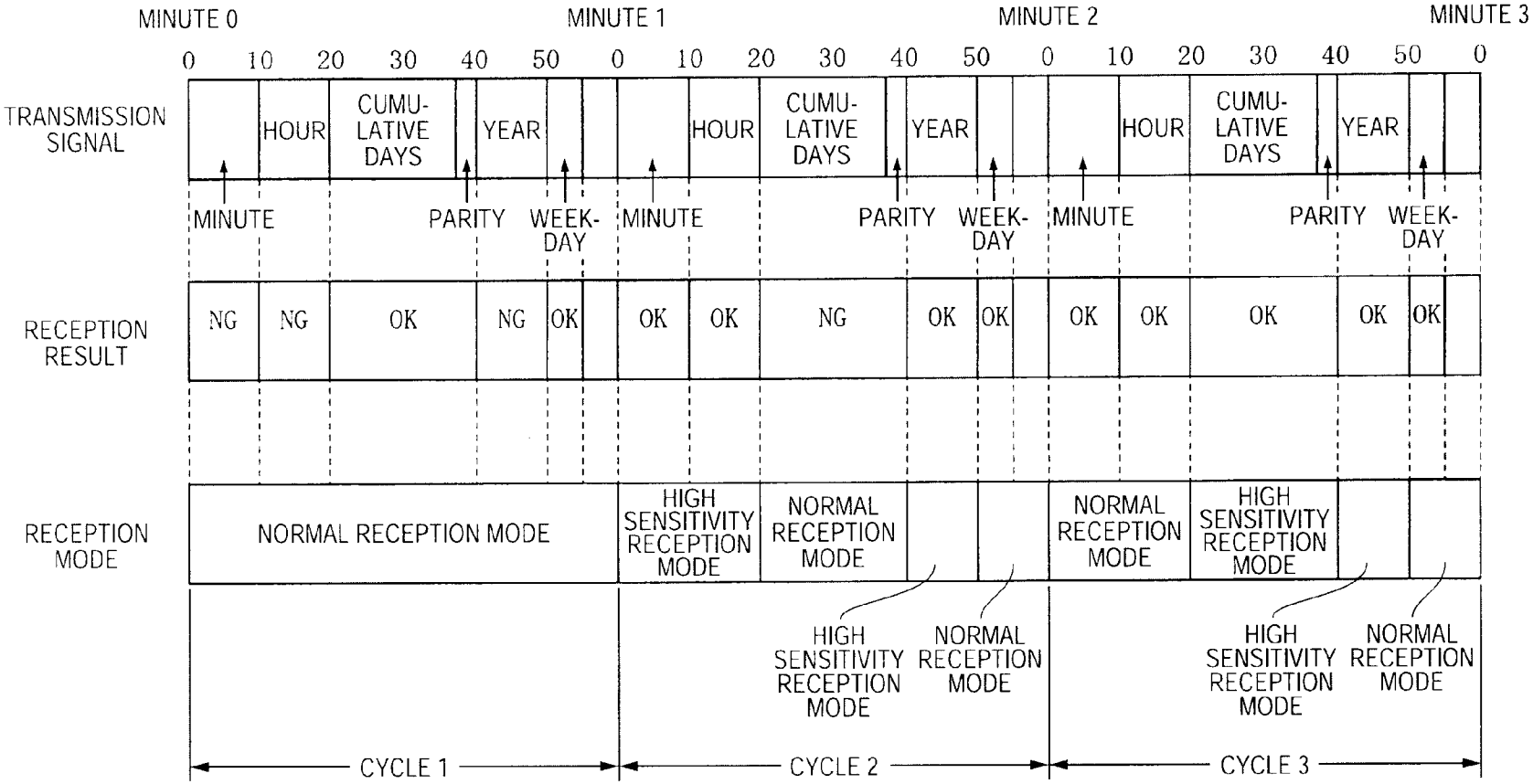
FIG. 9 shows the signal reception operation in the first embodiment of the invention.

FIG. 7 and FIG. 8 are flow charts showing the reception operation of this radio-controlled timepiece 1. FIG. 9 describes the reception control state. Note that the reception process shown in FIG. 7 and FIG. 8 is executed by the control unit 47 at the preset time for automatic signal reception and when reception is manually triggered by operating the external operating member 6.

When the reception process starts the control unit 47 of the radio-controlled timepiece 1 initially sets the reception mode to the normal reception mode, and initializes a variable N used to count the number of reception cycles to the starting value of 1 (S1).

The control unit 47 sends a control signal for setting the normal reception mode to the decoder circuit 39, and the decoder circuit 39 outputs a control signal setting the normal reception mode to the first amplifier circuit 32. When the control signal setting the normal reception mode is input, the first amplifier circuit 32 sets the constant current source 322 of the differential amplifier circuits 320 to the current level for the normal reception mode. As described above, the current level of the constant current source 322 when the normal reception mode is set is lower than the current level used in the high sensitivity reception mode. Note that the specific current level in the normal reception mode may be set based on the current consumption that is allowable in the normal reception mode with consideration for the battery capacity of the radio-controlled timepiece 1.

The control unit 47 operates the reception unit 3A through the decoder circuit 39 to select the reception channel (standard time signal output channel) (S2). The reception channel may be selected manually by the user, or a number of preset reception channels may be scanned to automatically select the reception channel based on the reception signal level, for example.

After the reception channel is selected the control unit 47 determines if second synchronization was successful (S3). For example, the signal pulse rises every second in the JJY standard time signal used in Japan, and synchronization to the second is possible by detecting the rising edge of the pulses at 1-second intervals.

If synchronization succeeds and step S3 returns Yes, the control unit 47 detects the marker and determines if synchronization to the minute succeeded (S4). As shown in FIG. 2, the part where the P0 position marker is followed by the minute marker M denotes the starting point of the time code, and synchronization to the minute is possible by detecting these consecutive markers.

This embodiment of the invention synchronizes with the second and acquires the markers in the normal reception mode, but seconds synchronization and marker acquisition can be done in the high sensitivity reception mode with the normal reception mode being used from time code acquisition in step S7.

This embodiment of the invention aborts the reception process if seconds synchronization and marker acquisition are not successful. More particularly, because seconds synchronization and marker acquisition must succeed in order to execute the process of acquiring the time code, executing the acquisition process in the high sensitivity reception mode can improve the probability of successful acquisition, and has the effect of improving the probability of being able to execute the time code acquisition process and the time adjustment process.

If step S3 or S4 returns No, the control unit 47 determines that the reception condition is poor, terminates reception (S5), returns to the normal timekeeping operation (S6), and ends the reception process. More specifically, operation of the stepping motor used to drive the movement is preferably stopped during standard time signal reception in order to prevent the introduction of noise to the received signal. This embodiment of the invention therefore stops the movement when reception starts in step S1, and when the reception process ends (S5) restarts the stepping motor and resumes normal operation of the movement.

However, if step S3 or S4 returns Yes, the control unit 47 executes the first cycle of the time code acquisition process in the normal reception mode (S7). More specifically, the time code of the standard time signal carries 60 bits per cycle (in 60 seconds). Each 60-second period of the time code is one cycle, and step S7 acquires the first cycle of the time code when more than one complete time code is received.

In step S7 the tuning circuit 31 tunes the antenna 2 to the frequency of the desired time signal, and converts the time signal received by the antenna 2 to a reception signal. The first amplifier circuit 32, bandpass filter 33, second amplifier circuit 34, and envelope detection circuit 35 then amplify the reception signal to a predetermined level, extract the signal of the desired frequency band, rectify and filter the extracted signal, and output the envelope signal. The A/D conversion circuit 37 then digitizes the envelope signal to produce the TCO signal, and outputs the TCO signal to the control circuit unit 4.

In order to acquire the first time code cycle in step S7, the control unit 47 synchronizes to the second and minute of the input TCO signal, and acquires the first time code cycle.

More specifically, as shown in FIG. 4 and FIG. 5, the standard time signal transmits a 1, 0, or P signal every second. The control unit 47 therefore detects the rising (or falling) edge of the input TCO signal, and determines if seconds synchronization is successful based on whether or not the pulse width of each pulse can be determined. If seconds synchronization is successful, the control unit 47 acquires (recognizes) the minute marker and determines if minute synchronization was successful.

If minute synchronization was successful, the control unit 47 receives the first cycle, that is, the first minute, of time data and acquires the time code (S7).

The control unit 47 stores the first cycle of time data (time code) output from the TCO decoder unit 41 in the storage unit 42, and checks if there is an error in any unit of time data in the acquired time code, that is, if there is an error in the minute, hour, cumulative days, year, or weekday values in the JJY signal, for example (S8).

One method of checking for errors in the time code units returns an error if the received data value is a value that is not possible. For example, if the value for the acquired minute indicates minute 70, the value exceeds the range of possible minute values and can therefore be determined to be an error. An error can be similarly returned if the value for any received time unit is not valid for that time unit.

Other methods of error checking the received time units may also be used, and multiple methods may be used in combination. For example, values that are transmitted with a parity bit (such as the minute and hour values in the JJY time code) can be verified using the parity bit (as shown in FIG. 2 and FIG. 8, a parity bit is inserted after the cumulative days field in the JJY signal).

If a plurality of time codes are acquired, errors can also be detected by comparing one time code with another time code. For example, if the time codes are acquired continuously for plural minutes, the minute values will change each minute but the hour, cumulative days, year, and weekday values will normally be the same. Therefore, whether a received time code is correct or not can be determined by comparing like time units in successive time codes.

The control unit 47 then adds 1 to N (S9), and starts the reception process (acquisition process) for the time code in the N-th cycle (S10). Because N is set to 1 in step S1, in step S9 N=N+1=1+1=2, and step S10 therefore starts the time code acquisition process for the second cycle the first time step S10 executes.

In the reception process for the second and subsequent cycles, the control unit 47 first determines if the timing for receiving one of the time units has been reached (S11). For example, if the JJY signal shown in FIG. 2 is being received, the reception timing for the minute field of the signal comes first, and is followed by the timing for the hour, cumulative day count, year, and weekday fields.

If the control unit 47 determines in step S11 that the reception timing of one of the time units has arrived, it determines if an error was detected in the value previously received for that time unit based on the result of the time code check described above (S12).

If an error in the previously received value is confirmed in step S12, the control unit 47 sets the reception unit 3A (see FIG. 1) to the high sensitivity reception mode and receives the time code for that time unit (S13).

More specifically, the control unit 47 instructs the first amplifier circuit 32 to enter the high sensitivity reception mode using the decoder circuit 39, and the first amplifier circuit 32 therefore sets the current of the constant current source 322 to the high sensitivity reception mode current level, which is higher than the normal reception mode current level. To prevent the gain from fluctuating greatly, the first amplifier circuit 32 may also adjust the resistance of the collector resistance 323 as necessary. The time code unit is then received in this high sensitivity reception mode.

If an error in the previously received value is not confirmed in step S12, the control unit 47 determines if the time code unit to be received is a time code unit without parity (the cumulative day count, year, or weekday in the JJY signal), and if an error was detected during reception of the time code for that time code unit between when reception started in step S1 and the current time, that is, if a no-parity time code unit in which an error was previously detected is to be received (S14).

If step S14 returns Yes, the control unit 47 sets the reception unit 3A to the high sensitivity reception mode and receives the time code for that unit of time (S13).

However, if step S14 returns No because the time code unit to be currently received is a time unit without parity and an error was not detected when the time code unit was previously received, or because the time code unit to be received is a unit with parity (such as the minute and hour units of the JJY signal) and an error was not detected when the time code unit was previously received, the control unit 47 sets the reception unit 3A to the normal reception mode and receives the time code for that unit of time (S15).

When a time code unit with parity is to be received, the control unit 47 therefore selects the high sensitivity reception mode only if there was an error when that time code unit was last received, and otherwise sets the normal reception mode.

On the other hand, when a time code unit without parity is to be received, the control unit 47 selects the high sensitivity reception mode if an error was detected any time that time code unit was previously received, including the last time it was received, and operates in the normal reception mode only if an error was not detected during a previous reception operation.

When the normal reception mode is selected, the control unit 47 instructs the first amplifier circuit 32 to enter the normal reception mode through the decoder circuit 39, and the first amplifier circuit 32 sets the current level of the constant current source 322 to the normal reception mode current level, which is lower than the high sensitivity reception mode current level. To prevent the gain from fluctuating greatly, the first amplifier circuit 32 may also adjust the resistance of the collector resistance 323 as necessary. The time code unit is then received in this normal reception mode.

The control unit 47 then determines if the reception process for the second cycle of the time code has been completed (S16). More specifically, if the JJY signal as shown in FIG. 2 is being received, the control unit 47 can determine that the reception process for the second cycle has been completed when the leap seconds data is received.

Note that when the year, weekday, leap seconds, or other time value is not needed for the radio-controlled timepiece 1 to set the time, reception of the second cycle may be determined to have ended when the minute, hour, and cumulative day count values have been received. More specifically, the end of reception determination in step S16 can determine that reception has ended when receiving the time code units previously determined to be necessary is finished.

If reception has not ended in step S16, control returns to step S11 and whether the timing for receiving the next time code unit has arrived is determined. For example, if receiving the minute field of the time code unit has ended, whether the timing for receiving the next hour field has arrived is determined (S11).

When receiving each of the time code units has ended and step S16 determines that reception of the N-th cycle is completed, the control unit 47 checks the received time code as described in step S8 (S17).

The control unit 47 then determines if no error was detected in the time code checked in step S17 and if acquisition was successful (S18).

If the control unit 47 determines in step S18 that reception was successful, the control unit 47 ends the reception process (S5), adjusts the time based on the acquired time code (S19), returns to normal control of the movement (S6), and ends the time code acquisition process.

However, if the control unit 47 determines in step S18 that acquisition failed, it determines if the cycle counter N is greater than a preset count M (S20).

If step S20 returns Yes, the control unit 47 ends reception (S5), returns to normal control of the movement (S6), and ends the time code acquisition process.

However, if step S20 returns No, the control unit 47 repeats the process from step S9 to step S20. More specifically, if the second cycle of the time code reception process has ended, counter N goes to N=2+1=3 in step S9, and reception of a third cycle of the time code starts in step S10.

The decision step of S20 is included to limit the number of times the reception process executes because power consumption simple increases as reception continues when time code acquisition fails.

More specifically, the decision of step S20 limits the number of times the time code reception process executes (the number of reception cycles) to a maximum count of M (such as 7), and reception ends if the reception process executes M times even if time code acquisition is not successful. The reception time is therefore limited to a maximum M minutes (7 minutes in this example), and the reception time is prevented from becoming any longer.

Note that this embodiment of the invention ends reception and adjusts the time as soon as step S18 determines that one time code is successfully received. Alternatively, when a plurality of time codes are acquired, the data received for each of the time codes can be compared, and reception can be determined successful and the time adjusted only when a predetermined number of values (such as three) match. Note also that because the time code is received every minute, each of plural consecutively received time codes will differ minute by minute. As a result, whether the time codes match can be determined by first adding 1 minute to the time code that is received first and then comparing that time code with the time code that was received next.

As shown in FIG. 9, the control method described above increases the possibility of successful reception because a time code unit that is not successfully received in one reception cycle (the reception result is "NG" in FIG. 9) is received in the high sensitivity reception mode during the next reception cycle.

In addition, if a time code unit with parity, such as the minute and hour of the JJY signal, is successfully received in one cycle (the reception result is "OK" in FIG. 9), that time code unit is received in the normal reception mode during the next reception cycle, and power consumption can be reduced.

Furthermore, if receiving a time code unit without parity, such as the cumulative days, year, and weekday of the JJY signal, fails in a previous reception cycle, that time code unit is received in the high sensitivity reception mode during the next reception cycle. For example, because receiving the time code unit for the year failed during the first cycle in FIG. 9, the year is received in the high sensitivity reception mode in the second and subsequent cycles. Thus, while receiving the year unit succeeds in the second cycle, it is also received in the high sensitivity reception mode in the third cycle.

Effect of the First Embodiment

After synchronizing with the second and minute units of the received standard time signal, the radio-controlled timepiece 1 according to this embodiment of the invention sets the reception mode to a high sensitivity reception mode for a predetermined time that is set based on the time code carried by the standard time signal, and more particularly for the reception time of a time code unit for which reception failed previously when receiving each time unit of the standard time signal.

More specifically, the control unit 47 controls reception of the first time code cycle in the normal reception mode, and sets the high sensitivity reception mode in the second time code reception cycle when the previous reception result for the same time code unit was an error (NG), and when any preceding reception result for a time code unit that is transmitted without parity returns an error. Power consumption can therefore be reduced compared with operating in the high sensitivity reception mode in all reception cycles. Furthermore, by setting the high sensitivity reception mode to receive the data for a time code unit for which reception previously failed, the probability of successfully acquiring the data for that time code unit can be improved, the correct time code can be received as a result, and the correct time can be set.

This aspect of the invention can therefore minimize the increase in power consumption, can improve the probability of success receiving the time code, and can improve reception performance under actual usage conditions.

When receiving a time unit that is transmitted without parity (such as the cumulative day count, year, or weekday of the JJY signal), the time code unit is always received in the high sensitivity reception mode after reception fails once. The probability of detecting an error in time code units without parity is lower than when receiving time code units transmitted with parity.

Because this aspect of the invention receives time code units without parity in the high sensitivity reception mode once reception has failed and frequently uses the high sensitivity reception mode, the probability of being able to detect errors can be improved and reception performance can be improved.

The high sensitivity reception mode is enabled by changing the current level of the constant current source 322 in the differential amplifier circuits 320 of the first amplifier circuit 32, requires increasing current only to the first amplifier circuit 32, and does not require increasing the current supply to other circuit components. The overall increase in current consumption by the radio-controlled timepiece 1 when the high sensitivity reception mode is selected can therefore be minimized, and reception performance can be improved effectively. Power consumption can therefore be suppressed and the duration time can be increased even when the radio-controlled timepiece 1 is a wristwatch with a small battery capacity.

Furthermore, because the first amplifier circuit 32 suitably adjusts the resistance of the collector resistance 323 when changing the current level of the constant current source 322 to prevent the amplification rate (gain) of the first amplifier circuit 32 from varying greatly, the A/D conversion circuit 37 will not produce errors when digitizing the input signal as a result of signal amplitude variations caused by variation in the gain, and detection errors can be prevented in the A/D conversion circuit 37.

The reception circuit unit 3 has a decoder circuit 39, and the decoder circuit 39 decodes the control signal input from the control circuit unit 4 and outputs the decoded control signal to the reception unit 3A.

Because the decoder circuit 39 thus decodes the control signal, a simple signal can be used as the control signal output from the control circuit unit 4, and signal communication reliability can be improved.

The reception circuit unit 3 and control circuit unit 4 are connected by a serial communication connection. Compared with connecting the reception circuit unit 3 and control circuit unit 4 using a parallel communication circuit, the number of communication paths can therefore be reduced and the circuit configuration of the radio-controlled timepiece 1 can be simplified. Control signals can also be serially output from the control circuit unit 4 to the reception circuit unit 3 over the serial communication path, and the data communication speed can be increased.

In addition, by connecting the reception circuit unit 3 and control circuit unit 4 with a pair of serial communication lines and enabling two-way communication, after the control unit 47 outputs a control signal to the reception circuit unit 3, the reception circuit unit 3 returns the received and recognized control signal to the control unit 47, and the control unit 47 can confirm if there are any differences between the control signal that was output from the control unit 47 and the control signal that is returned to the control unit 47. This configuration enables more highly reliable serial communication.

Embodiment 2

A second embodiment of the invention is described next with reference to the flow chart in FIG. 10 and FIG. 11 and the timing chart in FIG. 12. Note that parts that are the same or similar in any of the embodiments described herein are identified by the same reference numbers and further description thereof is simplified or omitted.

The first embodiment described above selects the normal reception mode or high sensitivity reception mode for each time code unit in one cycle of the standard time signal, that is, in the one minute (60 second) reception period. This second embodiment of the invention differs by selecting the normal reception mode or high sensitivity reception mode in the one-second period in which 1-bit of information is received.

Note also that this second embodiment differs from the first embodiment only in the method whereby the control unit 47 changes the reception mode. The configurations of the reception circuit unit 3 and the control circuit unit 4 are the same as in the first embodiment, and further description thereof is omitted.

Figure 10:
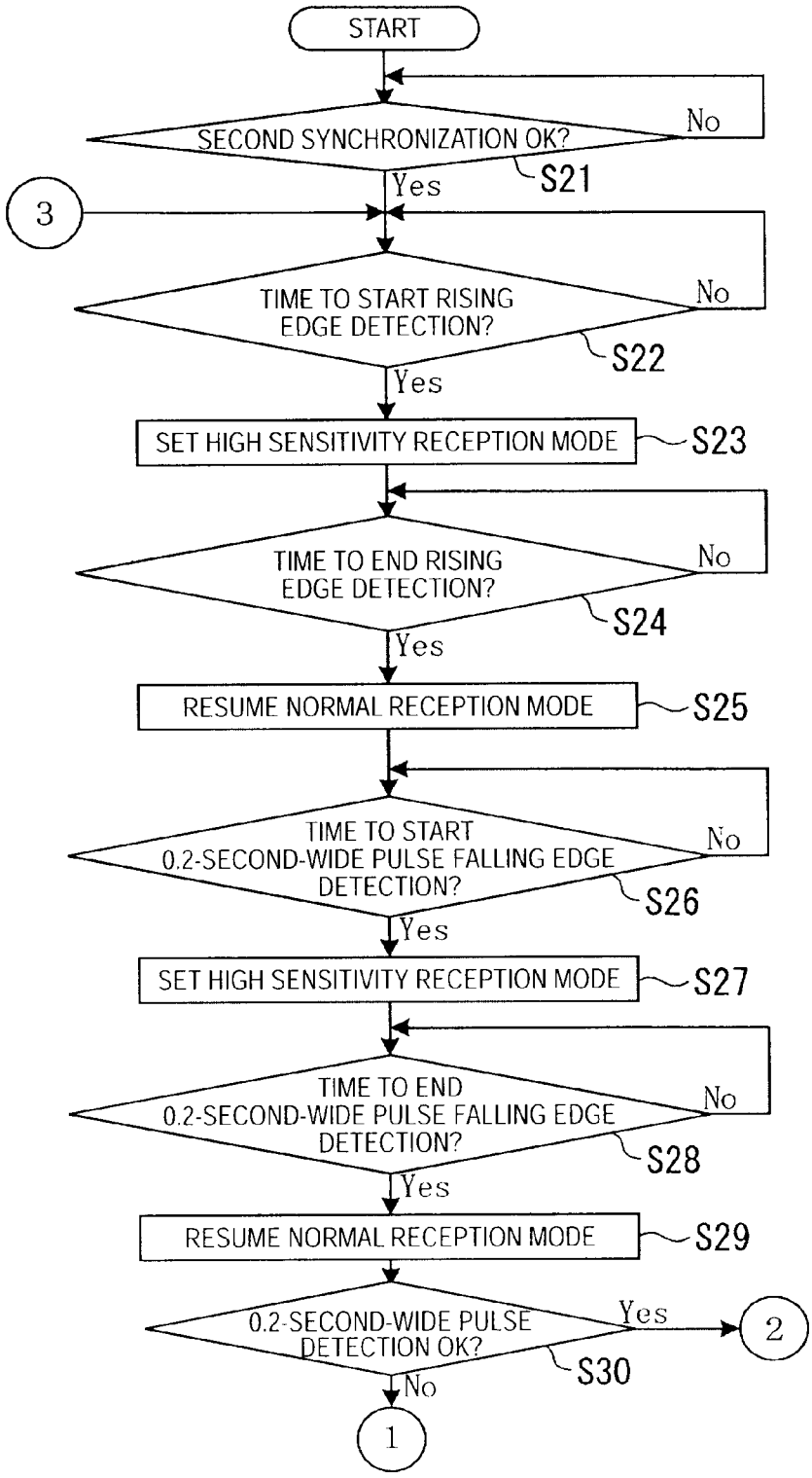
FIG. 10 is a flow chart showing the signal reception operation in the second embodiment of the invention.

In the second embodiment as shown in FIG. 10 the control unit 47 determines if second synchronization was successful after the reception process starts (S21). The control unit 47 then repeats this second synchronization determination process (S21) until step S21 returns Yes. Note that the channel selection process is also appropriately executed in this second embodiment.

If second synchronization is successful, the control unit 47 selects the high sensitivity reception mode for a predetermined period that is set based on the transmitted time code. As shown in FIG. 12, if the standard time signal is the JJY signal, there are four predetermined periods, specifically a rising edge detection period A, a 0.2-second-wide pulse falling edge detection period B, a 0.5-second-wide pulse falling edge detection period C, and a 0.8-second-wide pulse falling edge detection period D.

Each of these detection periods A to D is set referenced to the timing of the start of each bit in the time code detected by second synchronization, that is, referenced to the timing at a one-second interval.

More specifically, the rising edge detection period A is the period from the rising edge detection start time T1, which is set to a predetermined time before the reference time at which each pulse rises, to the rising edge detection end time T2, which is set to a predetermined time after this reference time. In this embodiment, for example, the detection start time T1 is set to 0.05 second before the reference time (reference time−0.05 second), and the detection end time T2 is set to the reference time+0.05 second. The detection period A is therefore 0.1 second long.

The 0.2-second-wide pulse falling edge detection period B is set from the 0.2-second-wide pulse falling edge detection start time T3, which is set to a predetermined time before the reference time at which each pulse rises, to the 0.2-second-wide pulse falling edge detection end time T4, which is set to a predetermined time after this reference time. In this embodiment, for example, the detection start time T3 is set to 0.15 second after the reference time (reference time+0.15 second), and the detection end time T4 is set to the reference time+0.25 second. The detection period B is therefore 0.1 second long.

The 0.5-second-wide pulse falling edge detection period C is set from the 0.5-second-wide pulse falling edge detection start time T5, which is set to a predetermined time before the reference time at which each pulse rises, to the 0.5-second-wide pulse falling edge detection end time T6, which is set to a predetermined time after this reference time. In this embodiment, for example, the detection start time T5 is set to 0.45 second after the reference time (reference time+0.45 second), and the detection end time T6 is set to the reference time+0.55 second. The detection period C is therefore 0.1 second long.

The 0.8-second-wide pulse falling edge detection period D is set from the 0.8-second-wide pulse falling edge detection start time T7, which is set to a predetermined time before the reference time at which each pulse rises, to the 0.8-second-wide pulse falling edge detection end time T8, which is set to a predetermined time after this reference time. In this embodiment, for example, the detection start time T7 is set to 0.75 second after the reference time (reference time+0.75 second), and the detection end time T8 is set to the reference time+0.85 second. The detection period D is therefore 0.1 second long.

If second synchronization is determined successful, the control unit 47 determines if the rising edge detection start time T1 has come (S22). The control unit 47 repeats step S22 until step S22 returns Yes.

When the control unit 47 confirms the rising edge detection start time T1 in S22, it sends a control signal through the decoder circuit 39 to the first amplifier circuit 32 and sets the reception mode of the first amplifier circuit 32 to the high sensitivity reception mode (S23).

The control unit 47 then determines if the rising edge detection end time T2 has come (S24). The control unit 47 repeats step S24 until step S24 returns Yes, and continues operating the reception unit 3A (more specifically the first amplifier circuit 32) in the high sensitivity reception mode.

When the control unit 47 confirms the rising edge detection end time T2 in S24, it sends a control signal through the decoder circuit 39 to the first amplifier circuit 32 and sets the reception mode of the first amplifier circuit 32 to the normal reception mode (S25).

The control unit 47 then determines if the 0.2-second-wide pulse falling edge detection start time T3 has come (S26).

Note that because second synchronization was successful in S21, the rising edge of the pulse is usually detected within the rising edge detection period A, which is set to the high sensitivity reception mode in S23. This embodiment therefore resets the normal reception mode in S25 when the rising edge detection period A ends, and then determines if the 0.2-second-wide pulse falling edge detection start time T3 has come.

However, anticipating situations in which the rising edge of the pulse cannot be detected in rising edge detection period A, control may be returned to the second synchronization confirmation process in S21 and the reception process may be aborted if the rising edge cannot be detected.

The control unit 47 repeats step S26 until step S26 returns Yes.

When the control unit 47 confirms the 0.2-second-wide pulse falling edge detection start time T3 in S26, it sends a control signal through the decoder circuit 39 to the first amplifier circuit 32 and sets the reception mode of the first amplifier circuit 32 to the high sensitivity reception mode (S27).

The control unit 47 then determines if the 0.2-second-wide pulse falling edge detection end time T4 has come (S28). The control unit 47 repeats step S28 until step S28 returns Yes, and continues operating the reception unit 3A (more specifically the first amplifier circuit 32) in the high sensitivity reception mode.

When the control unit 47 confirms the 0.2-second-wide pulse falling edge detection end time T4 in S28, it sends a control signal through the decoder circuit 39 to the first amplifier circuit 32 and sets the reception mode of the first amplifier circuit 32 to the normal reception mode (S29).

The control unit 47 then determines in the 0.2-second-wide pulse falling edge detection period B if the falling edge of the 0.2-second-wide pulse was detected (S30).

If step S30 returns No, the control unit 47 determines that a 0.2-second-wide pulse, that is, a position marker P bit, was not received and determines if a 0.5-second-wide pulse was received.

Figure 11:
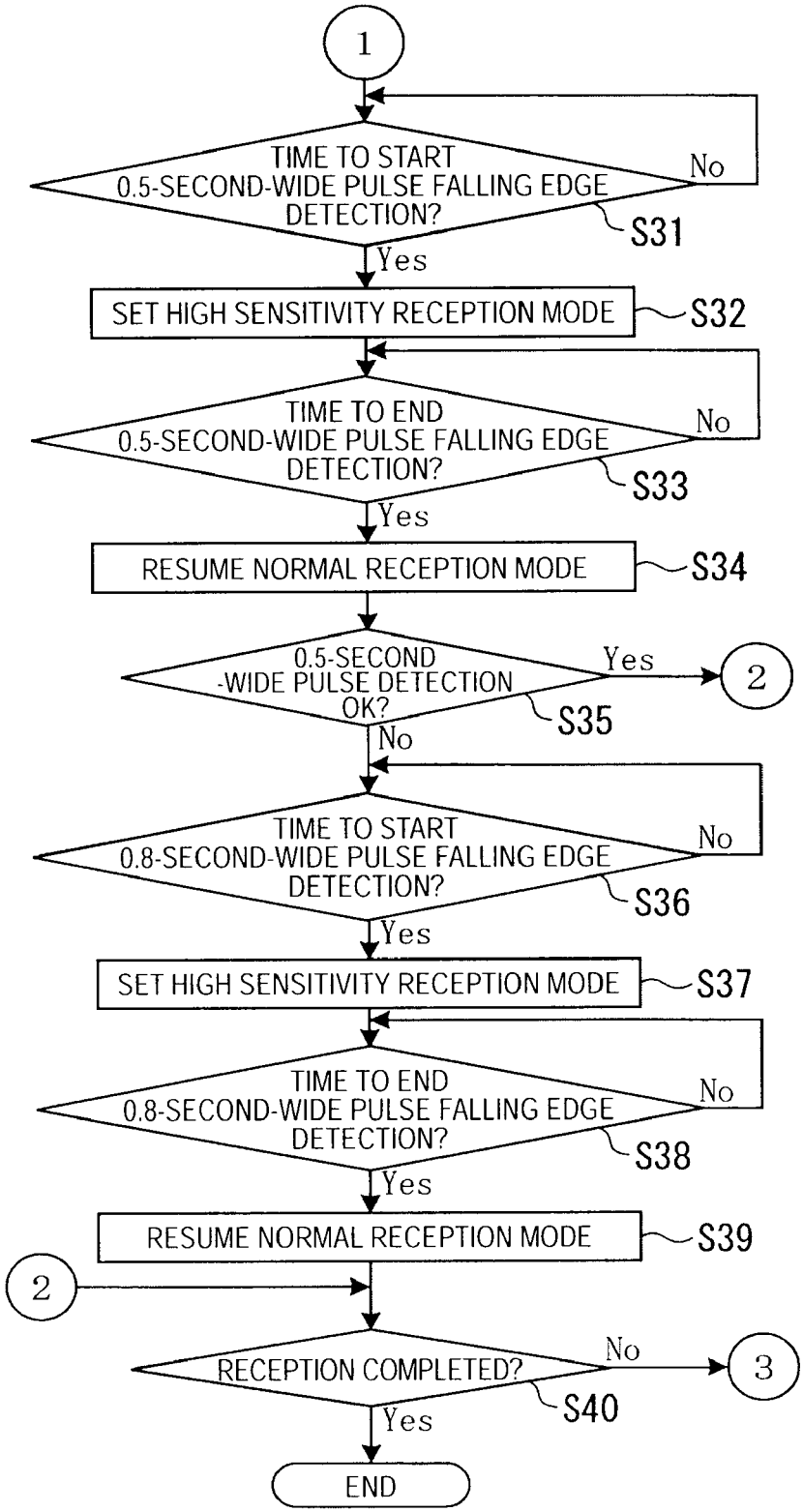
FIG. 11 is a flow chart showing the signal reception operation in the second embodiment of the invention.
Figure 12:
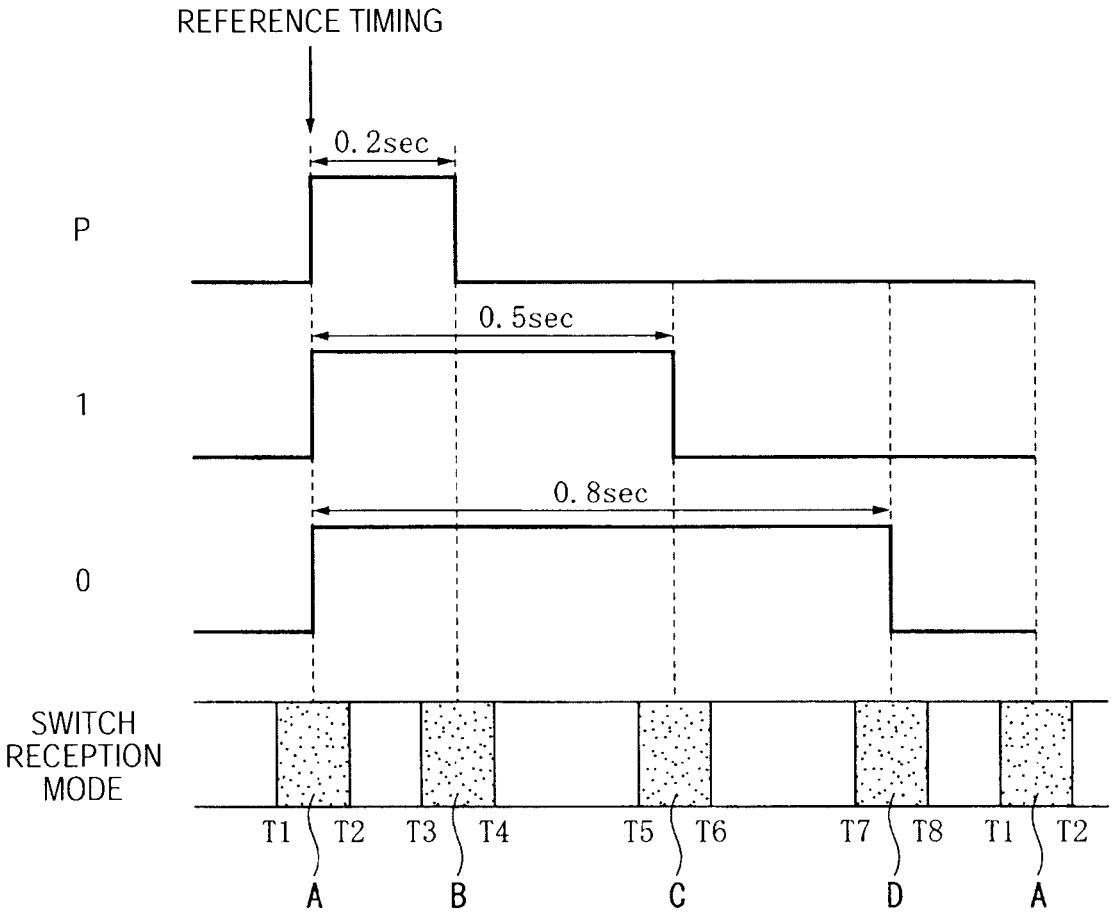
FIG. 12 is a timing chart showing the pulse detection period in the second embodiment of the invention.

More specifically, if step S30 returns No, the control unit 47 determines if the 0.5-second-wide pulse falling edge detection start time T5 has come as shown in FIG. 11 (S31).

The control unit 47 repeats step S31 until step S31 returns Yes.

When the control unit 47 confirms the 0.5-second-wide pulse falling edge detection start time T5 in S31, it sends a control signal through the decoder circuit 39 to the first amplifier circuit 32 and sets the reception mode of the first amplifier circuit 32 to the high sensitivity reception mode (S32).

The control unit 47 then determines if the 0.5-second-wide pulse falling edge detection end time T6 has come (S33). The control unit 47 repeats step S33 until step S33 returns Yes, and continues operating the reception unit 3A (more specifically the first amplifier circuit 32) in the high sensitivity reception mode.

When the control unit 47 confirms the 0.5-second-wide pulse falling edge detection end time T6 in S33, it sends a control signal through the decoder circuit 39 to the first amplifier circuit 32 and sets the reception mode of the first amplifier circuit 32 to the normal reception mode (S34).

The control unit 47 then determines in the 0.5-second-wide pulse falling edge detection period C if the falling edge of the 0.5-second-wide pulse was detected (S35).

If step S35 returns No, the control unit 47 determines that a 0.5-second-wide pulse, that is, a 1 bit, was not received and determines if a 0.8-second-wide pulse was received.

More specifically, if step S35 returns No, the control unit 47 determines if the 0.8-second-wide pulse falling edge detection start time T7 has come as shown in FIG. 11 (S36).

The control unit 47 repeats step S36 until step S36 returns Yes.

When the control unit 47 confirms the 0.8-second-wide pulse falling edge detection start time T7 in S36, it sends a control signal through the decoder circuit 39 to the first amplifier circuit 32 and sets the reception mode of the first amplifier circuit 32 to the high sensitivity reception mode (S37).

The control unit 47 then determines if the 0.8-second-wide pulse falling edge detection end time T8 has come (S38). The control unit 47 repeats step S38 until step S38 returns Yes, and continues operating the reception unit 3A (more specifically the first amplifier circuit 32) in the high sensitivity reception mode.

When the control unit 47 confirms the 0.8-second-wide pulse falling edge detection end time T8 in S38, it sends a control signal through the decoder circuit 39 to the first amplifier circuit 32 and sets the reception mode of the first amplifier circuit 32 to the normal reception mode (S39).

After resetting the normal reception mode in step S39, the control unit 47 determines if reception has been completed (S40). For example, because one time code from the standard time signal is received in 60 bits (60 seconds), the control unit 47 acquires the minute marker by acquiring each data bit to synchronize to the minute, and then acquires one time code cycle by continuing reception for 60 seconds. The control unit 47 then determines if reception has ended by determining if a predetermined number of time codes, such as seven time codes, has been received (S40).

If step S30 or step S35 returns Yes in this second embodiment of the invention, the control unit 47 goes directly to determining if reception has ended in S40 without executing the intervening pulse detection steps. More specifically, if the falling edge of the 0.2-second-wide pulse is detected in step S30, there is no need to detect the falling edge of the 0.5-second-wide pulse or the 0.8-second-wide pulse. Likewise, if the falling edge of the 0.5-second-wide pulse is detected in step S35, there is no need to detect the falling edge of the 0.8-second-wide pulse. As a result, if step S30 or step S35 returns Yes the control unit 47 goes to step S40 to determine if reception is completed.

If reception is not completed and step S40 returns No, the control unit 47 returns to step S22 and repeats steps S22 to S40 to receive the next one second of data (the next bit). The control unit 47 thus repeats steps S22 to S40 until determining in step S40 that reception is completed.

This second embodiment of the invention can reliably receive the falling edge of each pulse because it sets one of detection periods A to D based on the time code when receiving each data bit and switches to the high sensitivity reception mode during each detection period A to D. As a result, data reception errors can be reduced bit by bit, and the correct data can be received. In addition, because pulse changes are not detected and are ignored at times other than in detection periods A to D, erroneously recognizing noise that is outside the detection period as a pulse change can be prevented and reception errors can be further reduced.

Furthermore, because time code pulses in this standard time signal have a falling edge at 0.2 second, 0.5 second, or 0.8 second, and the detection periods A to D are set timed to the falling edge of the pulse, the time that the high sensitivity reception mode is active can be minimized. The increase in power consumption when the high sensitivity reception mode is selected can therefore be suppressed. For example, if each of the detection periods A to D is 0.1 second long, the time that the high sensitivity reception mode is active within 1 second can be kept to a very short 0.4 second, and current consumption can be held to less than half the current consumption when the high sensitivity reception mode remains active for 1 second.

Furthermore, when the falling edge of the pulse is detected in detection periods B and C, operation does not switch to the high sensitivity reception mode during the remaining part of that detection period. Operating unnecessarily in the high sensitivity reception mode can therefore be eliminated, and increased power consumption can be suppressed.

Embodiment 3

Figure 13:
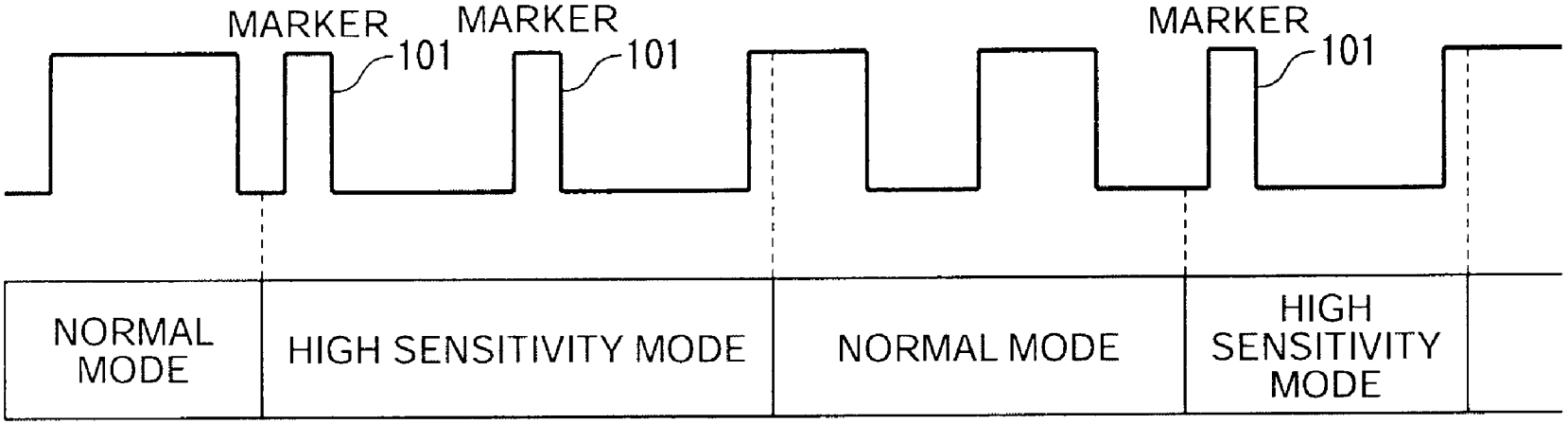
FIG. 13 is a timing chart showing setting the reception mode in the third embodiment of the invention.

A third embodiment of the invention selects the high sensitivity reception mode when receiving pulses with a narrow width in the standard time signal as shown in FIG. 13.

Figure 14:
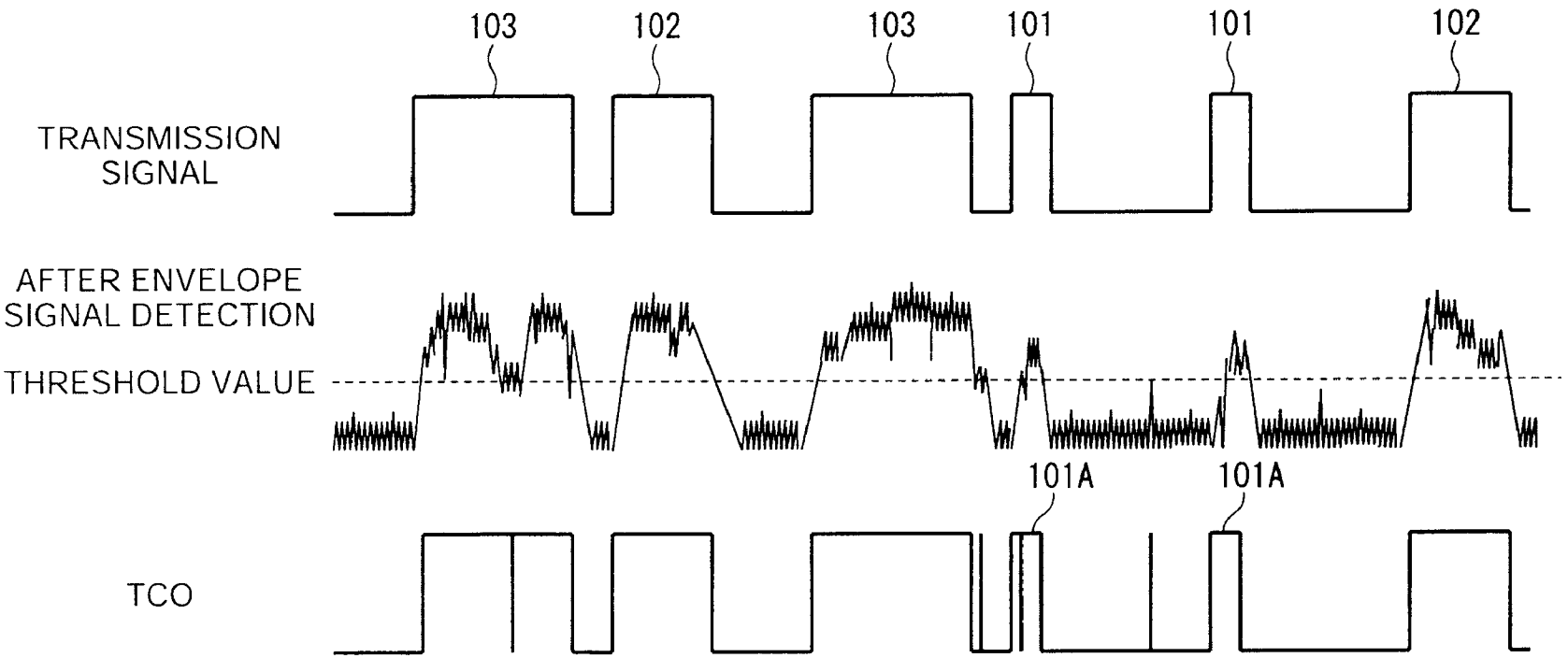
FIG. 14 shows the transmitted signal, the signal after envelope detection, and the TCO signal.

More specifically, as described above in the first embodiment the standard time signal transmitted in Japan expresses P, 1, and 0 data values using signals with pulse widths of 0.2 second, 0.5 second, and 0.8 second. As shown in FIG. 14, a narrow pulse 101 with a 0.2-second pulse width tends to have a lower amplitude when the rising edge is gradual than a 0.5-second-wide pulse 102 or a 0.8-second-wide pulse 103. As a result, digitizing signals with a narrow pulse width becomes difficult when the signal amplitude is low and the field is weak. More specifically, when the TCO is acquired by digitizing the signal after envelope detection using a predetermined threshold value, the amplitude of pulse 101 in particular is low and the pulse width of the corresponding pulse 101A in the TCO signal becomes shorter, possibly resulting in the pulse 101A being considered noise.

As also shown in FIG. 2 the M (minute marker) and P (position marker) pulses with a narrow pulse width are transmitted at seconds 0, 9, 19, 29, 39, 49, and 59.

Furthermore, because the leading minute marker M must be acquired for minute synchronization, the high sensitivity reception mode is entered after second synchronization is confirmed to facilitate acquiring the minute marker M and enable minute synchronization. If operation is thereafter controlled to switch from the normal reception mode to the high sensitivity reception mode only at the timing when the P and M markers are transmitted as in this embodiment of the invention, the narrow pulses can be received more reliably.

The control unit 47 in the third embodiment of the invention therefore sets the first amplifier circuit 32 to the high sensitivity reception mode based on the time code after second synchronization and minute synchronization, or more particularly at the timing when the P marker, that is, when a 0.2-second-wide pulse 101, is transmitted in the time code, so that pulses 101 with a narrow pulse width can also be accurately detected.

By thus setting the reception process to the high sensitivity reception mode at the timing when pulses 101 with a narrow pulse width that can easily cause data evaluation errors are transmitted, this third embodiment of the invention can accurately detect the pulses 101.

In addition, because the high sensitivity reception mode is set only at the timing when narrow pulses 101 are transmitted, current consumption can be reduced compared with always operating in the high sensitivity reception mode.

Embodiment 4

A fourth embodiment of the invention is described next.

The fourth embodiment of the invention differs from the first to third embodiments described above in the configuration of the reception circuit unit 3 that implements the high sensitivity reception mode. The configuration of the fourth embodiment can therefore be applied to any of the foregoing first to third embodiments, which differ in the timing at which the high sensitivity reception mode is set.

Figure 15:
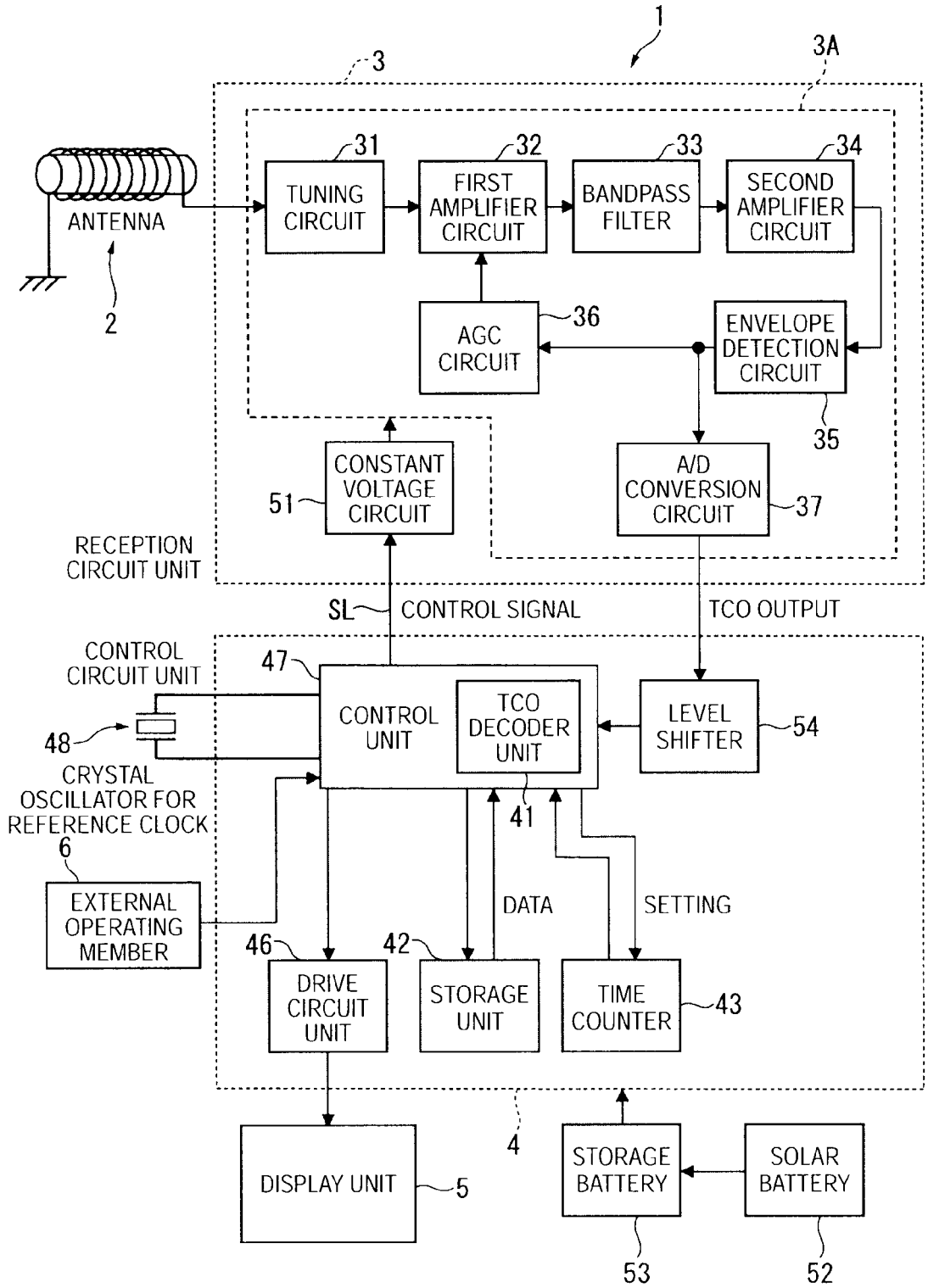
FIG. 15 is a block diagram showing the configuration of a radio-controlled timepiece according to a fourth embodiment of the invention.

As shown in FIG. 15 the fourth embodiment has a constant voltage circuit 51 that can switch the operating voltage of the reception unit 3A between a plurality of levels.

More specifically, to set the high sensitivity reception mode in the first to third embodiments only the operating current flowing to the first amplifier circuit 32 changes, and the operating current of the other circuits does not change.

The radio-controlled timepiece 1 according to this fourth embodiment of the invention, however, has a constant voltage circuit 51 that can switch the output voltage between at least two levels, and sets the output voltage of the constant voltage circuit 51 to a higher level when the high sensitivity reception mode is selected than when the normal reception mode is selected. More particularly, the control unit 47 controls the reception mode by switching the operating voltage of the reception unit 3A. Power is supplied to the constant voltage circuit 51 from a storage battery 53.

The reception unit 3A operates according to the output from the constant voltage circuit 51. In the normal reception mode the constant voltage circuit 51 outputs a voltage of 1.5 V, for example, and in the high sensitivity reception mode outputs a voltage of 2.4 V, for example. As the operating voltage rises the allowable amplitude variation rises, the dynamic range increases, and the S/N ratio can be improved. As a result, the current consumption of the reception circuit unit 3 also increases.

The power supply of the radio-controlled timepiece 1 according to the fourth embodiment of the invention includes a solar battery 52 and the storage battery 53. The solar battery 52 in this embodiment of the invention uses five or six solar battery cells connected in series to increase the voltage, and the storage battery 53 is a 2.5-V class battery.

Furthermore, because the TCO output from the A/D conversion circuit 37 is affected when the operating voltage of the constant voltage circuit 51 is switched between two levels, this fourth embodiment of the invention also has a level shifter 54 to adjust the output level before input to the control unit 47.

This fourth embodiment of the invention does not require changing the configuration of the reception unit 3A, can render a high sensitivity reception mode by simply adding a constant voltage circuit 51 to an existing circuit configuration, and therefore enables implementing the invention even in existing circuit configurations.

More specifically, this embodiment of the invention can be easily achieved even in devices not having a constant current source 322 that can change the output current to the first amplifier circuit 32, and can therefore use existing circuit designs.

Embodiment 5

A fifth embodiment of the invention is described next.

The fifth embodiment of the invention differs from the first to fourth embodiments described above in the configuration that implements the high sensitivity reception mode. The configuration of the fifth embodiment can therefore be applied to any of the foregoing first to fourth embodiments, which differ in the timing at which the high sensitivity reception mode is set.

Figure 16:
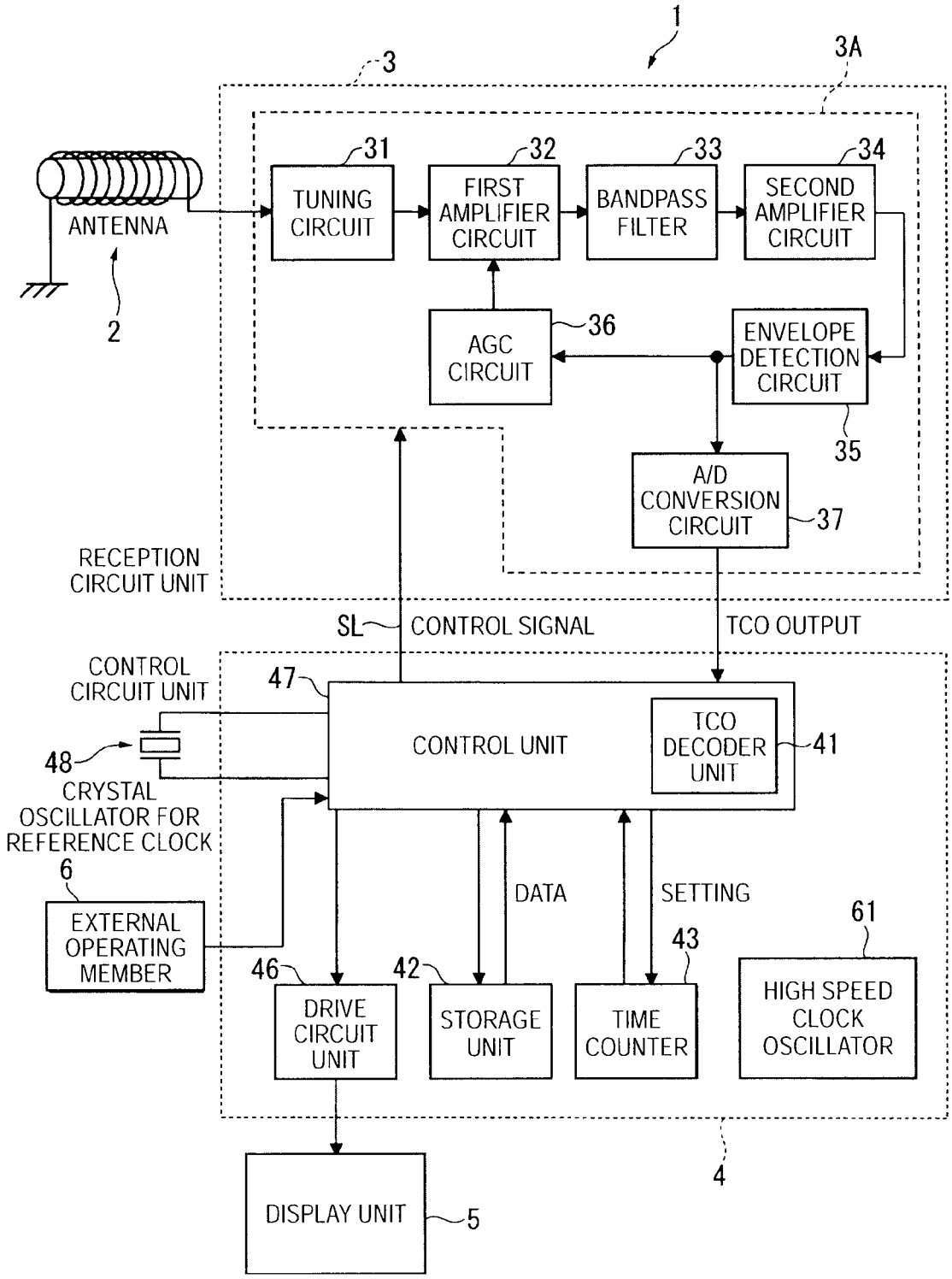
FIG. 16 is a block diagram showing the configuration of a radio-controlled timepiece according to a fifth embodiment of the invention.

As shown in FIG. 16 the fifth embodiment adds a high speed clock oscillator 61 to improve the performance of the control circuit unit 4.

The high speed clock oscillator 61 is configured to output a 1-MHz clock signal, for example, by operating an internal CR oscillator, for example. The operating clock frequency of the control circuit unit 4 is therefore set to 32 Hz in the normal reception mode and to 1 MHz in the high sensitivity reception mode, for example.

Figure 17:
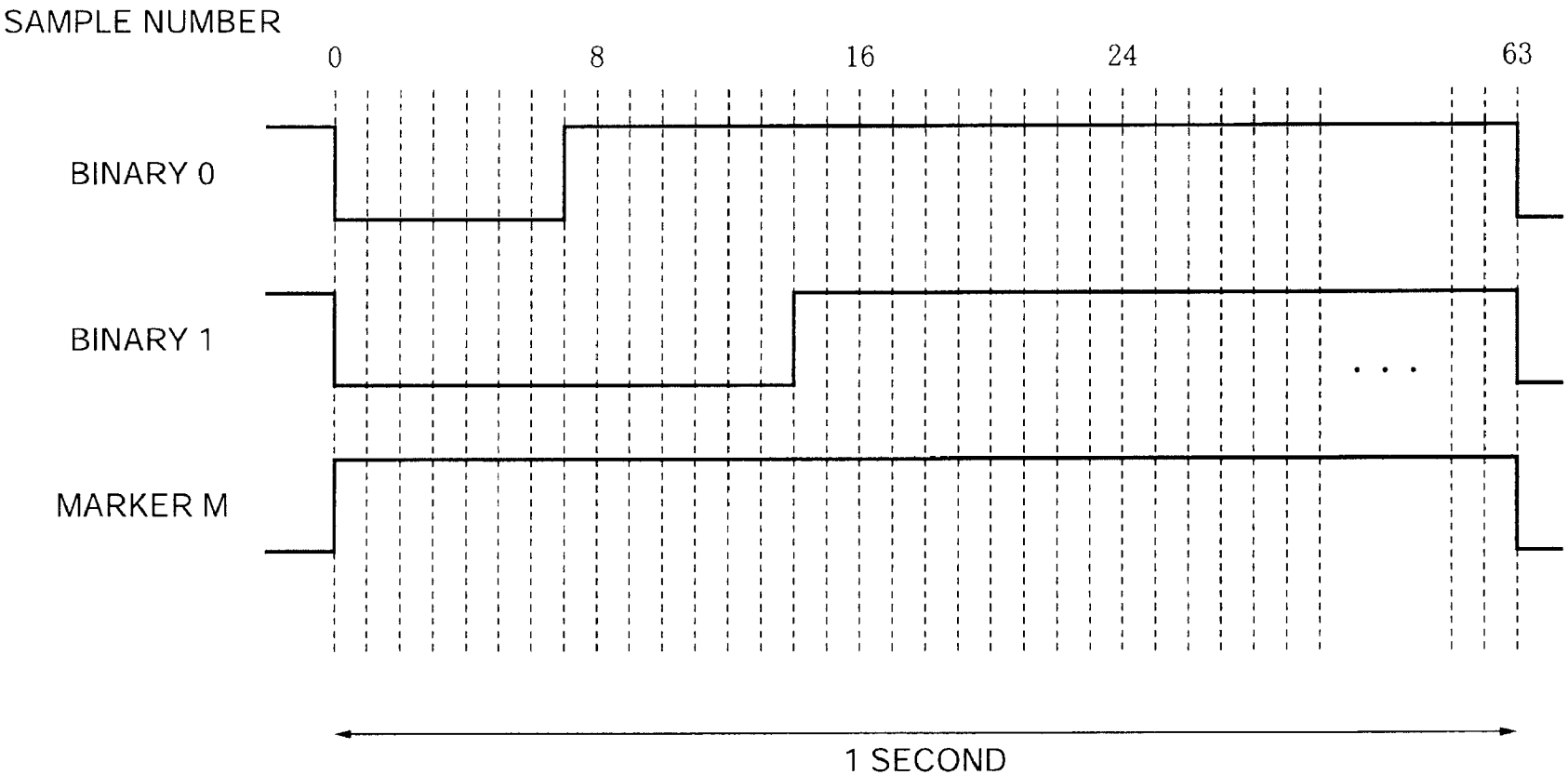
FIG. 17 illustrates signal sampling in the fifth embodiment of the invention.

Signal processing performance can be improved in the high sensitivity reception mode by setting the operating clock of the control circuit unit 4 to a high clock rate. This enables driving the TCO sampling clock at a high speed, enables acquiring the accurate pulse width, and enables removing noise, and as a result can improve reception performance. For example, as shown in FIG. 17, the difference in the pulse width denoting a 0 and the pulse width denoting a 1 in the German DCF77 time signal is a mere 0.1 second, and these pulses can therefore be easily erroneously detected. Therefore, by changing the 32-Hz sampling clock that is used in the normal reception mode to a 64-Hz clock in the high sensitivity reception mode, the pulse width detection precision can be doubled, and pulses of different widths can be reliably differentiated and detected. However, increasing the clock frequency also increases the current consumption of the control circuit unit 4.

This fifth embodiment of the invention does not require changing the configuration of the reception circuit unit 3, and can render a high sensitivity reception mode by simply adding a high speed clock oscillator 61 to the control circuit unit 4 and modifying the software. This fifth embodiment can therefore be easily implemented even in existing circuit configurations.

Variations

The invention is not limited to the embodiments described above.

Figure 18:
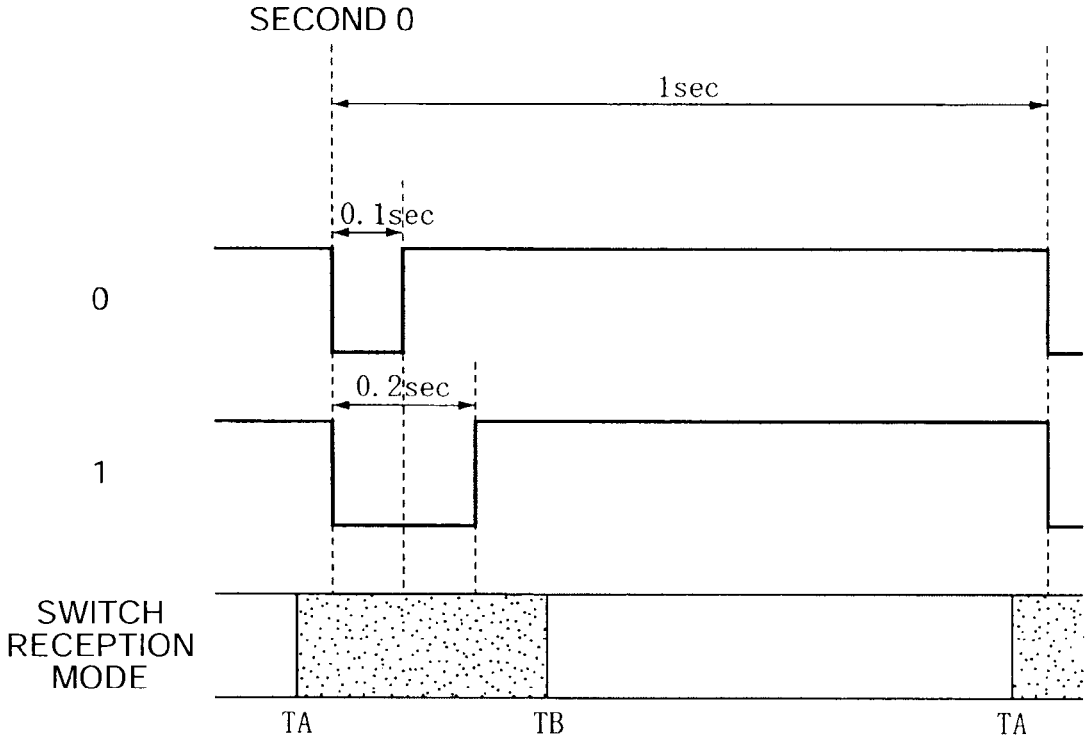
FIG. 18 is a timing chart showing the pulse detection period in another embodiment of the invention.

For example, if the radio-controlled timepiece 1 can receive the standard time signals that are transmitted in different countries and selects the mode for receiving the German DCF77 standard time signal when the DCF77 time signal can be received, the radio-controlled timepiece 1 may be set to operate in the high sensitivity reception mode. More specifically, because the DCF77 signal uses pulses of 0.1 second and 0.2 second widths as shown in FIG. 18, the amplitude of the received signals is low and detection errors occur easily as described in the third embodiment. Therefore, by setting the high sensitivity reception mode when receiving the DCF77 signal, each pulse can be correctly received and reception performance can be improved.

Figure 19:
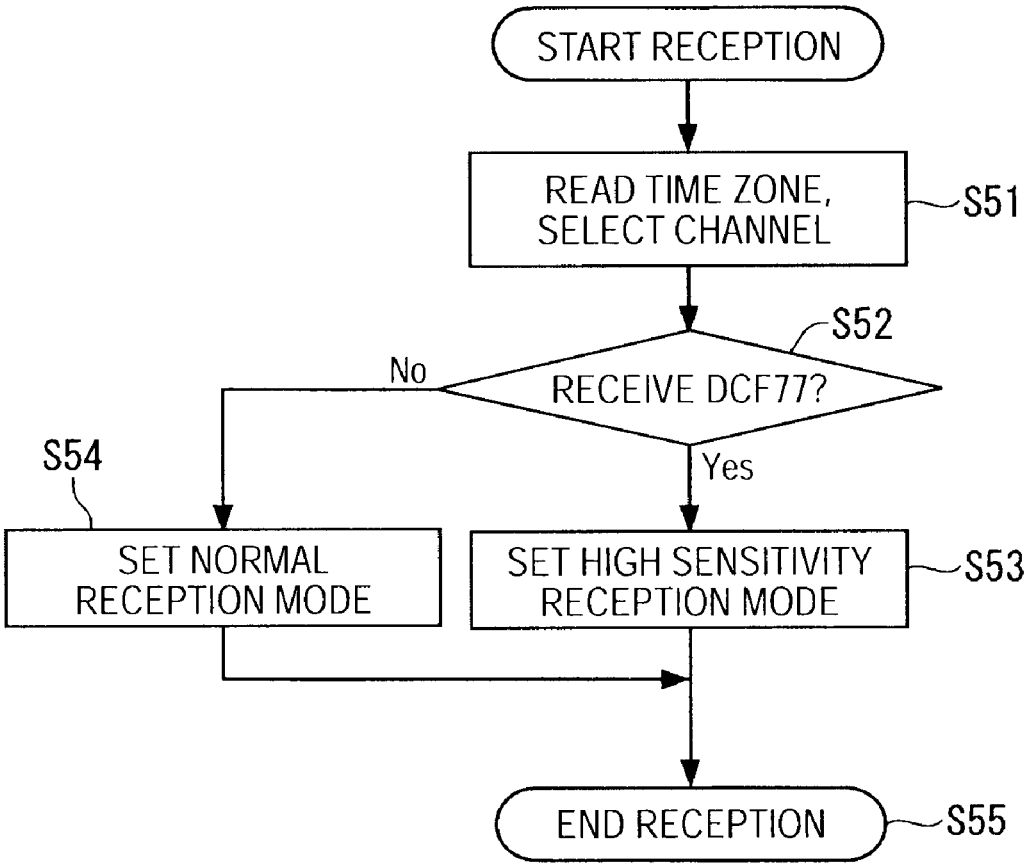
FIG. 19 is a flow chart showing the signal reception operation in another embodiment of the invention.

More specifically as shown in FIG. 19, when reception starts, the control unit 47 reads the time zone setting and automatically selects the reception channel (S51). For example, if the radio-controlled timepiece 1 can receive three standard time signals, such as the JJY, WWVB, and DCF77 signals, the control unit 47 selects the JJY signal if the time zone setting of the radio-controlled timepiece 1 is set to Japan, and selects the DCF77 signal if the time zone is set to Germany.

The control unit 47 then determines if the DCF77 signal is to be received (S52). If step S52 returns Yes, the control unit 47 sets the reception mode of the reception circuit unit 3 to the high sensitivity reception mode (S53), and if No is returned sets the reception mode to the normal reception mode (S54). As a result, the DCF77 signal is received in the high sensitivity reception mode, but the JJY and WWVB signals are received in the normal reception mode.

When reception in the selected reception mode is completed, the control unit 47 then ends the reception process (S55).

Figure 20:
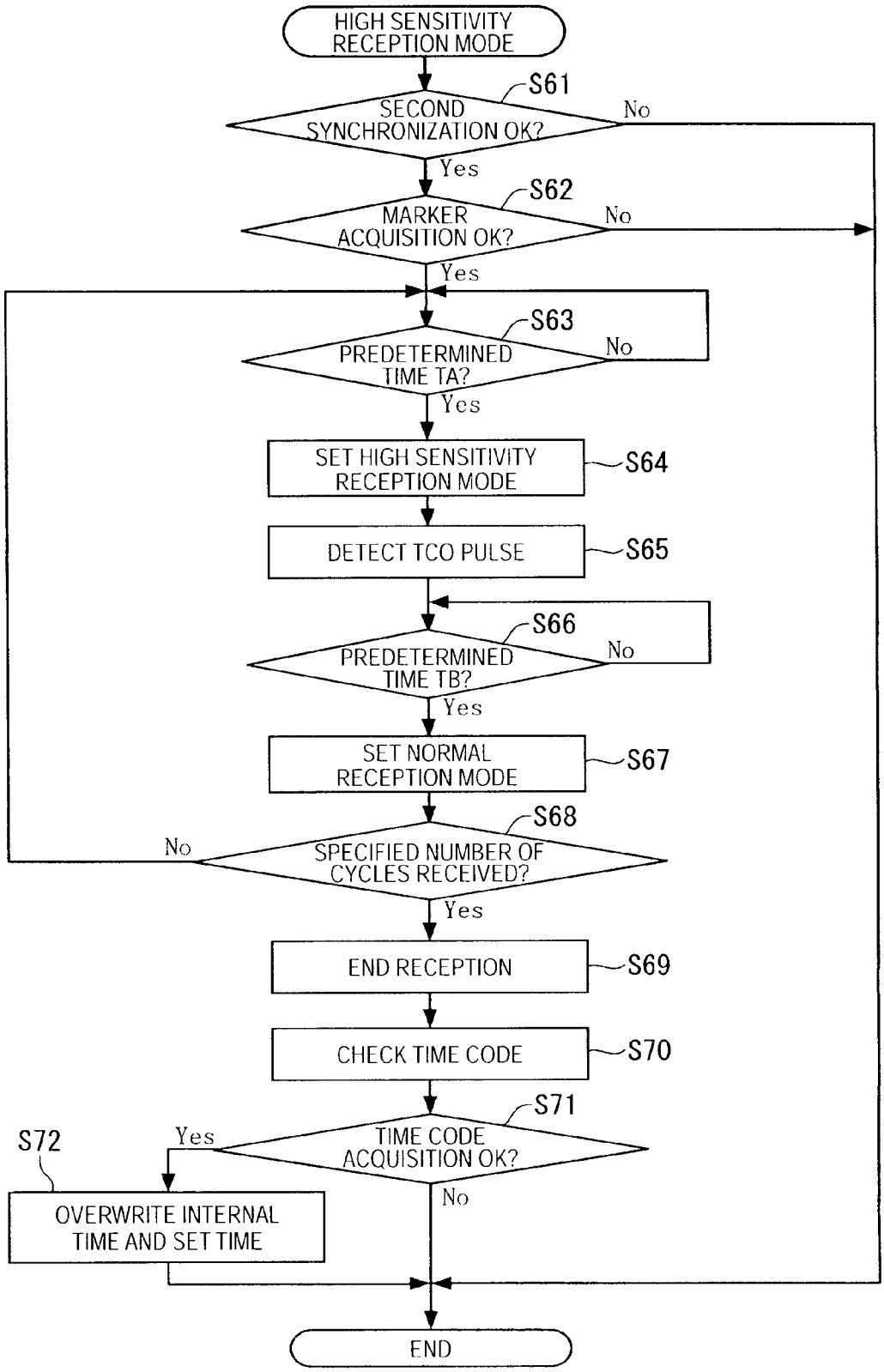
FIG. 20 is a flow chart showing operation of the high sensitivity reception mode in another embodiment of the invention.

As shown in FIG. 20, when the high sensitivity reception mode is set the control unit 47 determines if second synchronization was successful (S61) and if the minute marker M was acquired (S62) as described in the foregoing embodiments.

If second synchronization succeeded and the minute marker M was acquired, the control unit 47 determines if a predetermined time TA has come (S63). As shown in FIG. 18, this predetermined time TA is a predetermined time before second 0 of each minute, such as 50 msec before second 0.

If the control unit 47 determines that the predetermined time TA has come, it switches to the high sensitivity reception mode (S64) and detects the TCO pulse (S65).

As described in the embodiments above, the specific process of the high sensitivity reception mode increases the operating current of the first amplifier circuit 32, or increases the drive voltage of the reception unit 3A, or increases the operating clock of the control circuit unit 4.

The control unit 47 then determines if a predetermined time TB has come (S66), and switches to the normal reception mode if the predetermined time TB has arrived (S67). As shown in FIG. 18, this predetermined time TB is a predetermined time after second 0 of each minute, such as 400 msec after second 0.

As a result, as shown in FIG. 18, reception continues in the high sensitivity reception mode from time TA to time TB when receiving the DCF77 signal, and otherwise operates in the normal reception mode. The 100 msec and 200 msec pulses that are transmitted in the DCF77 signal from second 0 can therefore be received in the high sensitivity reception mode.

Note that the high sensitivity reception mode is enabled from predetermined time TA 50 msec before second 0 to allow some extra operating time so that each pulse from second 0 can be reliably received. More specifically, if the high sensitivity reception mode is entered before second 0, operation can proceed reliably in the high sensitivity reception mode from second 0 even if there is some time lag in switching to the high sensitivity reception mode as a result of changing the current or voltage level.

In addition, the high sensitivity reception mode is sustained until predetermined time TB 400 msec after second 0 because when the 200 msec pulse is received the pulse width of the output signal from the envelope detection circuit 35 is sometimes longer than 200 msec.

The control unit 47 then determines if reception of a particular cycle has been completed (S68). As in the foregoing embodiments, a specific number of time code cycles, such as two to four cycles, are received because the wrong time data may be detected due to noise contained in the time code if only one cycle (60 seconds) of the standard time signal is received.

If step S68 returns No, the control unit 47 repeats steps S63 to S67. If step S68 returns Yes, the control unit 47 ends the reception process (S69).

More specifically, the reception operation continues in this embodiment of the invention while the normal reception mode is set. If the reception operation is stopped while in the normal reception mode, it may not be possible to switch to the high sensitivity reception mode at second 0 because several seconds are needed to restart the reception circuit unit 3. However, because reception performance drops in the normal reception mode from time TB to time TA compared with the high sensitivity reception mode and noise can be easily included in the received signal, the TCO pulses are preferably not detected and change in the TCO pulses is ignored.

Note that operation may be switched to the high sensitivity reception mode before the minute marker is acquired after second synchronization is established in step S61 in the flow chart shown in FIG. 20. This enables acquiring the minute marker in the high sensitivity reception mode quickly and with good precision, and can therefore also reduce current consumption.

After reception ends, the control unit 47 checks the acquired time code (S70) as described in the embodiments above. The control unit 47 also determines if time code acquisition was successful (S71). If time code acquisition was successful, the internal time is overwritten and the displayed time is adjusted based on the time information decoded from the acquired time code (S72), and the reception process ends.

However, if step S61, S62, or S71 returns No, the control unit 47 ends the reception process without overwriting the internal time.

The foregoing first embodiment switches to the high sensitivity reception mode when a time code unit that produced an error was received in the previous reception cycle, but the reception mode may be preset for each time code unit.

For example, because the minute and hour units contain a parity bit, the reliability of the received data is high. The normal reception mode may therefore be set when receiving the minute and hour time code units, and the high sensitivity reception mode may be set when receiving other time code units that do not contain a parity bit.

In addition, in combination with the first embodiment, if an error occurs in the minute or hour time code unit during one reception cycle, the same time code unit can again be received in the normal reception mode during the next reception cycle with other time code units received first in the normal reception mode and the high sensitivity reception mode set only if an error occurred in the previous reception cycle.

Further alternatively in the first embodiment, the reception process can be executed plural times, capturing plural time code cycles, and the data for a time code unit in which an error is detected in the data received in one cycle can be corrected using data for the time code unit from another cycle received in the high sensitivity reception mode.

When the standard time signal is continuously received at one minute intervals, the time values other than the minute are usually the same. For example, if reception starts from 2:00 a.m. and continues for 7 minutes to receive seven data cycles, the minute value will change from 0 to 6, but the values for the hour, date, year, weekday, and other time units will not change and remain the same. Therefore, because the data for a time code unit in which an error was detected can be corrected by receiving it in the high sensitivity reception mode, adjusting the time using incorrect data can be reliably prevented.

If reception of a time code unit transmitted without a parity bit fails once, the foregoing first embodiment switches to and continues operating in the high sensitivity reception mode to receive that time code unit again. However, similarly to receiving time code units transmitted with parity, the high sensitivity reception mode could be set only if reception previously failed, and the normal reception mode may be used if reception was previously successful.

In addition, the second embodiment sequentially detects the detection periods B to D. Alternatively, however, the pulse width of each bit may be predicted using the internal time and previously received data bits so that only one of the detection periods B to D is detected for each bit.

More specifically, because the transmission time of the marker bits can be determined if both second synchronization and minute synchronization are completed, pulse edge detection may be limited to detection period A to detect the rising edge and detection period B to detect the falling edge of the 0.2-second-wide pulse when a bit denoting a marker is transmitted.

In addition, because the likelihood that the date, year, weekday and other time information kept by the internal clock will differ from the received data is low when the standard time signal is received at a regular scheduled time, the data bit to be received can be predicted from the internal time information and the detection period can be set based on the predicted data in the periods when the date, year, and weekday values are received. For example, detection period C for detecting the falling edge of a 0.5-second-wide pulse can be set at a bit where transmission of a 1 bit can be predicted from the internal time data, and detection period D for detecting the falling edge of a 0.8-second-wide pulse can be set at a bit where transmission of a 0 bit can be predicted from the internal time data.

Furthermore, the method of achieving a high sensitivity reception mode is not limited to the methods described in the foregoing embodiments of the invention, and any method that can improve reception performance can be used. For example, the methods used in the high sensitivity reception modes described in the foregoing embodiments may be used in various combinations.

Furthermore, the foregoing embodiments describe methods of switching the reception mode of the reception unit between a normal reception mode and high sensitivity reception mode. However, by enabling switching the processing capacity of the control unit between two levels, the invention can be rendered as a method of switching the control unit between a normal reception mode and a high sensitivity reception mode.

The standard time signal that is received by the radio-controlled timepiece 1 according to the invention is not limited to the JJY signal transmitted in Japan, and the radio-controlled timepiece 1 can be configured to receive the standard time signals that are transmitted in other countries. In this case the period (timing) for receiving in the high sensitivity reception mode is set appropriately according to the time code format of the standard time signal used in a particular country.

In addition, if the timepiece is an analog watch that drives the hands using a motor, stepping the hour hand and minute hand can be controlled according to the reception mode. For example, detection periods A to D are set each second in the second embodiment above, and there is basically no change in the pulse signal outside of detection periods A to D. Therefore, if the movement is driven at a time outside of detection periods A to D (the periods when the high sensitivity reception mode is set), the motor coil emits a magnetic field when a motor pulse is output to drive the movement, and this magnetic field is picked up by the antenna 2 and produces noise, the resulting noise can be differentiated from the signal pulses. Therefore, if the motor is driven in a period when the high sensitivity reception mode is not set, the correct time data can be received without being affected by noise from the motor coil.

The reception process of the invention described above is not limited to being used when the time signal is received automatically at a preset time, and can be executed when reception is started manually using the external operating member 6. Furthermore, the condition for automatic reception is not limited to a fixed time for receiving the signal at a predetermined time, and may be set to execute once a day when an outdoor location is detected using a solar cell or ultraviolet sensor, for example.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A radio-controlled timepiece that receives a standard time signal containing a time code and adjusts internal time data, comprising:

a reception unit that receives the standard time signal; and a control unit that controls the reception unit;

the reception unit including:

an amplifier circuit that amplifies a reception signal of the standard time signal, and an analog/digital conversion circuit that digitizes the amplified reception signal and acquires a time code; and the control unit setting the reception mode of the reception unit to a normal reception mode or to a high sensitivity reception mode that improves reception performance compared with the normal reception mode, setting the reception mode to the high sensitivity reception mode for a specific period that is set based on the time code of the standard time signal after establishing at least second synchronization with the time code of the standard time signal, and otherwise setting the reception mode to the normal reception mode.

2. The radio-controlled timepiece described in claim 1, wherein:

the specific period is a period for receiving a time information unit of the time code in which there was an error when the time information unit was previously received.

3. The radio-controlled timepiece described in claim 1, wherein:

the specific period is a detection period that is preset according to the pulse width of each bit in the standard time signal.

4. The radio-controlled timepiece described in claim 1, wherein:

the specific period is a period for receiving a pulse of which the pulse width of each bit in the standard time signal is less than or equal to a preset pulse width.

5. The radio-controlled timepiece described in claim 1, wherein:

the control unit sets the operating voltage of the reception unit to a higher level when the reception mode is set to the high sensitivity reception mode than when the normal reception mode is set and improves reception performance.

6. The radio-controlled timepiece described in claim 1, wherein:

the control unit sets the operating current of the reception unit to a higher level when the reception mode is set to the high sensitivity reception mode than when the normal reception mode is set and improves reception performance.

7. The radio-controlled timepiece described in claim 6, wherein:

the control unit sets only the operating current of the amplifier circuit of the reception unit to a higher level when the reception mode is set to the high sensitivity reception mode than when the normal reception mode is set and improves reception performance.

8. A control method for a radio-controlled timepiece that receives a standard time signal containing a time code and adjusts internal time data, the timepiece comprising a reception unit that receives the standard time signal; and a control unit that controls the reception unit; the reception unit including an amplifier circuit that amplifies a reception signal of the standard time signal, and an analog/digital conversion circuit that digitizes the amplified reception signal and acquires a time code; the control method comprising:

setting a reception mode of the reception unit to a high sensitivity reception mode that improves reception performance compared with a normal reception mode for a specific period that is set based on the time code of the standard time signal after establishing at least second synchronization with the time code of the standard time signal, and otherwise setting the reception mode to the normal reception mode.

* * * * *